US006287194B1

(12) United States Patent
Okada et al.

(10) Patent No.: US 6,287,194 B1
(45) Date of Patent: Sep. 11, 2001

(54) GAMING MACHINE

(75) Inventors: Kazuo Okada; Yukinori Inamura; Hiroyuki Danjo, all of Tokyo (JP)

(73) Assignee: Aruze Corporation, Tokyo (JP)

( * ) Notice: Subject to any disclaimer, the term of this patent is extended or adjusted under 35 U.S.C. 154(b) by 0 days.

(21) Appl. No.: 09/070,252

(22) Filed: Apr. 30, 1998

(30) Foreign Application Priority Data

Apr. 30, 1997 (JP) ..... 9-112648
Jan. 30, 1998 (JP) ..... 10-019634

(51) Int. Cl.[7] ..... A63F 9/22
(52) U.S. Cl. ..... 463/16; 463/20; 273/139
(58) Field of Search ..... 463/1, 6, 16–20, 463/30, 31, 25, 21, 22, 23; 273/138 A, 138.1, 139

(56) References Cited

U.S. PATENT DOCUMENTS

| | | | | |
|---|---|---|---|---|
| 5,127,651 | * | 7/1992 | Okada | 273/143 R |
| 5,472,195 | * | 12/1995 | Takemoto et al. | 463/31 |
| 5,560,603 | * | 10/1996 | Seelig et al. | 463/6 |
| 5,630,753 | | 5/1997 | Fuchs | 463/9 |
| 5,695,402 | * | 12/1997 | Stupak | 463/20 |
| 5,833,537 | * | 11/1998 | Barrie | 463/21 |
| 5,876,284 | * | 3/1999 | Acres et al. | 463/25 |
| 5,997,401 | * | 12/1999 | Crawford | 463/20 |

FOREIGN PATENT DOCUMENTS

| | | |
|---|---|---|
| 3701622A | 8/1998 | (DE) . |
| 0558307A | 9/1993 | (EP) . |
| 2157047A | 10/1985 | (GB) . |
| 09103537A | 8/1997 | (JP) . |
| WO 94/01840 | 1/1994 | (WO) . |

* cited by examiner

*Primary Examiner*—Mark Sager
*Assistant Examiner*—John M Hotaling, II
(74) *Attorney, Agent, or Firm*—Rohm & Monsanto, PLC

(57) ABSTRACT

A gaming machine is provided with a principal variable display for displaying principal graphical information corresponding to at least one of a plurality of principal graphical elements, each such principal graphical element having a predetermined significance in a principal game of the gaming machine. A secondary display displays secondary graphical information that constitutes any combination of secondary information predictive of the results that will be obtained in the play of the principal game, a secondary game, and/or timing information. A principal controller produces first control signals that control the principal variable display to display the principal graphical information as a sequential principal progression of the principal graphical elements, and second control signals that control the secondary display to display the secondary graphical information. The secondary graphical information has a predetermined relationship to the sequential progression of the principal graphical elements. The principal graphical elements may be in the form of symbols arranges about a rotating mechanical element, such as a reel of a slot machine. The secondary graphical information is in the form of images and/or alpha-numeric data.

25 Claims, 22 Drawing Sheets

| 7 | BAR | | | LOSS |
|---|---|---|---|---|
| 20 | 50 | 15 | 30 | 40 |

GAMING MACHINE

BACKGROUND OF THE INVENTION

1. Field of the Invention

This invention relates generally to gaming machines, and more particularly to gaming machines such as slot machines or the like that have a variable display for displaying image information representative of a plurality of symbols necessary for a game and a controller for controlling the variation action of the variable display.

2. Description of the Related Art

A gaming machine such as a slot machine usually has a mechanical variable display formed of rotatable display elements that are provided with a plurality of symbols disposed on peripheral surfaces thereof. The symbols are visible through a display window at the front of the slot machine. Alternatively, an electrical variable display is formed of indicating elements with symbols on a display screen. In response to a "start" operation by a player, a controller drives the variable display to start the rotation of each rotatable display element and to stop the rotation of each rotatable display element in a determined sequence automatically after a predetermined period of time has elapsed, or in response to initiation of a "stop" operation by the player. When the rotation of all of the rotatable display elements has ceased, there is shown a specific combination of symbols (winning pattern) in the display window. The player is then given an award by paying out gaming medium such as coins. In a recent popular model of a gaming machine, a "win" corresponding to a predetermined plurality of winning symbols being completely positioned on the effective line of the display when rotation of the rotatable display elements ceases occurs only when a win has been established by a system internal to the gaming machine. In a practical machine, this happens when a sampling operation of a random number issued by a microcomputer has been determined to constitute a win.

The reason why such gaming machines have become popular is that if the particular symbols that appear on the display when the rotatable display elements are stopped were to depend completely on the stop operation, or timing, of the player, the end result (i.e.,win or loss) of the game would be responsive to the skill of the player. Consequently, only the relative abilities of the players would be emphasized, and the wholesomeness of the game would be compromised. A further reason for the popularity of such machines is that their designers have solved a number of problems related to management of the pay out rate of the coins for amusement shops.

In such known gaming machines, a microcomputer decides which symbols are to be displayed when the display variation ceases, and controls the stopping of the variation action to display the predetermined symbols. It is often difficult for the player to wait for symbols to be displayed when the variation in the display stops, and until such time, the player merely waits to obtain the result. There is a need, therefore, for a gaming machine that overcomes the known problems relating to obtaining the winning indication from the display.

In one effort at alleviating these problems, a gaming machine is provided with a game indication device that operates in response to the occurrence of a predetermined winning condition. When a winning condition occurs on this game indication device, the gaming machine is itself caused to assume a winning condition. With such gaming machine, the player can enjoy a "big hit" for a period of time while the "big hit" condition is completed. Moreover, the probability of occurrence of a hit is increased. This known arrangement, however, is operated for the duration of the winning condition of the gaming machine. This means that the game indication device does not work till a result of the game performed by the gaming machine itself is obtained. Therefore, the gaming machine is not different from the conventional gaming machine in that the player must wait over a period from beginning of the game to the time when the result of the game is obtained.

A further known slot machine is provided with a second display unit in addition to the main variable display for displaying a plurality of symbols. In this slot machine, a game in the second display unit is performed in determined time (service time) when a game can be performed without coin insertion by interrupt control. Also, the game of the second display unit is performed during the service time and occurs after the completion of the usual game. This means that the second display does not operate when the main display for performing the original game of slot machine is working. Therefore, this further known gaming machine does not solve the problems discussed above with respect to certain conventional gaming machines in that the player has to wait from beginning of the game to the time when the result of the game is obtained. Thus, in conventional gaming machines, if a further display device is provided in addition to the variable display, the player merely watches signals varying on the variable display over the duration of the main game.

SUMMARY OF THE INVENTION

An object of this invention is to provide a gaming machine that maintains player interest by performing some indications on the variable display over the period from beginning to the end of the main game, and wherein signals necessary for the game are viewed.

Another object is to provide a game machine having an enhanced, staged operating characteristic such that the player can easily recognize or anticipate a result of the game performed by the variable display by watching the indications thereon.

In accordance with the invention, a gaming machine has a variable display for displaying image information representative of a plurality of symbols necessary for a game, a controller for controlling display of the variable display, and a secondary display being optionally provided to display an optional image, the image displayed by the secondary display being determined in relation to the control of the variable display by the controller.

The secondary display may include electric displays such as liquid crystal, CRT, and LED, as well as mechanical displays having rotating display elements of structure as are used in conventional slot machines.

The image displayed by the secondary display may be distinguished each other by using various kinds of characters and figures, animations, light flashing on and off, and the like. The images for the secondary display can be classified into several kinds such as "prognostic" images that lead the player to believe that a particular display, such as a "big hit," is to occur, images indicating promotion of "big hit," images indicating "big hit," images indicating "loss," images giving expectation for "big hit" to the player. For example, a memory of a microcomputer can store such images as data.

According to the present invention, a controller controls the variation action of the variable display during game time. As a result of the game, a win or loss occurs in response to the signals that are shown in the display at the time the variation action has stopped.

The controller controls the operation of the game to determine which signals are to be shown when the variation in the display ceases, as well as determining the game result and cessation of the variation in the display.

The image displayed by the secondary display is different from that of the variable display, and is determined by the controller.

Consequently the player can predict or expect a result of the game during the variation shown in the variable display. In one embodiment of the invention, the controller determines an image to be displayed by the secondary display and causes the secondary display to display the determined image. The particular image that is determined in relation to the control of the variable display is, as stated, decided by the controller. This image includes information relating to the control state corresponding to the various kinds of possible game results, such as win or loss, kinds of win such as small hit, big hit, or the like, decided by the controller. In addition, this image includes a game display that is necessary for performing individual or separate games.

In an embodiment of the invention, the secondary display includes a display control unit that determines an image in response to the command from the controller, and a display unit for displaying the image. Since the secondary display has associated therewith the display control unit for determining an image in response to the command from the controller, the particular image displayed is determined by the display control unit.

In this embodiment of the invention, the image presented by the secondary display varies with the progress of the variation of the variable display. Since the image of the secondary display changes with the progress of the variation of the variable display, the player feels that the game result varies with the lapse of time and maintains his or her expectation relative to the game result.

In a further embodiment of the invention, the image in the secondary display is a prognostic display that causes the player to anticipate a particular combination of symbols to be displayed by the variable display at the time the variation of the variable display stops. The player, therefore, can anticipate a result such as a "big hit" and the like by watching the prognostic display and hence, his or her interest to the game is enhanced.

In still another embodiment of the invention, the controller controls the variable display to play games continuously, two or more times. The image of the secondary display is a prognostic display that causes the player to anticipate the start of a second, or later, game. Thus, even if the first game is finished, by watching the prognostic display on the secondary display, the player can anticipate the start of the second game, and an expect subsequent game.

In another embodiment of the invention, the image of the secondary display is a game display that is necessary for performing an individual or separate game that is different from the game performed by variation of the variable display. According to this embodiment, the player can enjoy the original game by the variable display and an individual or separate game performed by the secondary display at the same time, or as an alternate game.

In a still further embodiment of the invention, the secondary display displays an image in relation to control over the variation of the variable display by the controller during the operation of the variable display. While the variable display is not varying, the secondary display displays an image constituting an individual game that is performed independently from the variable display control by the controller. According to this embodiment of the invention, the individual game of the secondary display may be controlled corresponding to the game result of the variable display or may be independently controlled. Although this individual game may be configured so as not to consume game medium such as coins, the starting or winning condition of the individual game may be established to require that coins or the like be deposited.

If the display schedule of the individual game of the secondary display is modified, the game of the variable display will appear to have been rescheduled, without any modification of the gaming machine itself.

In an embodiment of the invention, the image shown by the secondary display can be switched to represent the number of times the game is played, or the probability of win or loss of each game. Thus, the secondary display is a record of the number of times or probability of win or loss of each game. The player then can judge the gaming machine to determine whether a hit will or will not appear.

In another embodiment of the invention, the variable display has a plurality of variable display units disposed laterally with respect thereto and the controller controls the variation of the variable display units so as to stop the variation in the middle, or central, variable unit last. According to this embodiment, by disposing the secondary display at the central position, a sense of unity between the image of the secondary display and stop result of the variable display can be developed.

In still another embodiment of the invention, the secondary display displays a plurality of images in a predetermined sequence to provide a progressive story when the variable display indicates it will reach a winning condition if the variable display would display a specific remaining symbol. According to this embodiment, the player's expectation as to the ultimate game result is enhanced, and the attention of the player is directed to the image of the secondary display. Consequently, the player can keep his expectation of a particular result until the actual result of the game is obtained.

In a further embodiment of the invention, the respective images of the secondary display are associated with different degrees of expectation (reliability) that a win will be realized by a specific combination of symbols displayed by the variable display, at such times as the variation in the display is caused stopped. According to this embodiment, the degrees of expectation, or reliability, of a winning game are realized by a specific combination of symbols that are to be displayed by the variable display when the variation is stopped is caused to be different for each image. The player therefore senses the changes in the degree of expectation that a particular game result will be achieved when the variation in the display is terminated.

In one embodiment of the invention, the last image in the variation of the secondary display informs of a winning game that is realized by a specific combination of symbols displayed by the variable display when the variation stops. According to this embodiment, the player can easily recognize a win by watching the last image of the secondary display.

In a still further embodiment of the invention, the secondary display performs a slow replay of the variation, after the original variation has run its course by displaying the last image. The slow replay is effected by the slow variation of images from the image shown before to the last image. Thus, the player's interest at the time that the game results in a win is further enhanced.

The secondary display further operates, in one embodiment of the invention, to indicate the remaining time in a second-by-second count that corresponds to each image until the last image is displayed in the progression of the variation of the images. According to this embodiment, the player a high level of tension in the game until the result of the game is obtained.

In yet another embodiment of the invention, the progression of the variation of the images of the secondary display is configured in plural modalities. According to this embodiment, as the variation of the images of the secondary display progresses in accordance with plural kinds of modes, or manners, thereof, the player's interest in the game is enhanced. The plural kinds of modes of the progress of the variation of the images of the secondary display have associated therewith different degrees of expectation in achieving the winning combination of symbols when the variation in the secondary display is stopped. As the degree of expectation to obtain the winning combination of symbols is changed in each mode of the progression, the player can recognize the degree of expectation not only by an image, but also by the mode of the progression of the variation of the images. The player, therefore, expects the particular game result and also watches carefully the progression of variation of images having different degree of expectation. As a result, the play plays the game with a high level of tension. In a specific illustrative embodiment of the invention, the specific image that is displayed by the secondary display after the variation of the variable display has initiated is a predictive image that assists in predicting that a winning game would be obtained if the variation of the images would change in accordance with specific manner of the progression of the images. Particularly when the specific manner of the progression of the images is advantageous for the player, the player can anticipate the manner in which the progression of the images develops by watching the predictive image.

BRIEF DESCRIPTION OF THE DRAWING

The foregoing and other objects, features, and advantages of the invention will become more apparent from the following detailed description taken in conjunction with the accompanying drawings, in which.

DETAILED DESCRIPTION

Figure 1:
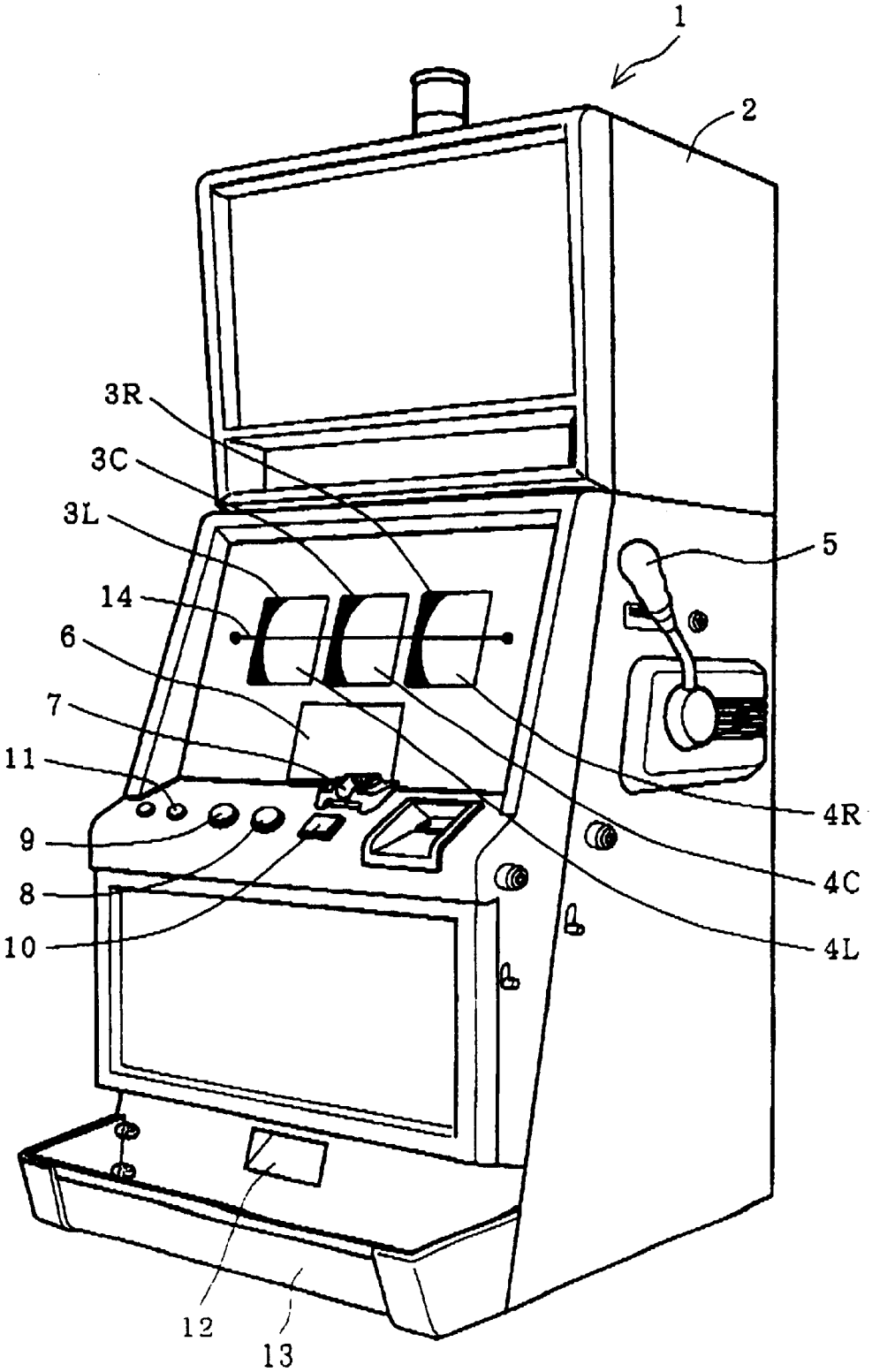
FIG. 1 is an isometric representation of a specific illustrative embodiment of the invention in the form of a slot machine.

FIG. 1 is an isometric representation of a specific illustrative embodiment of the invention in the form of a slot machine 1. Slot machine 1 is a gaming machine played using a coin, a medal or a token (not shown), and the like as game media. Hereinafter, the game media will be referred to as "medal."

On the front face of a cabinet 2 forming a housing for slot machine 1, three display windows 3L, 3C, and 3R are arranged in a horizontal line. Additionally, various kinds of symbols (not shown in this figure) are displayed on the central winning line 14 or its upper and lower positions of each display window, as will be described hereinbelow with respect to FIG. 6. These symbols are drawn on the surface of the sheet forming circumferential planes of three rotatable display elements 4L, 4C, and 4R which are arranged inside of cabinet 2 in correspondence to display windows 3L, 3C, and 3R. A mechanically variable display is formed of these rotatable display elements. On the side surface of cabinet 2 is provided a start lever 5 for rotating the rotatable display elements in response to actuation by a player (not shown). Lever 5 is arcuately displaceable within a predetermined range of angular motion. Further, a liquid crystal display 6 is arranged to display information, as will be described hereinbelow, and is shown to be located at lower center of the display windows of the front face of cabinet 2. The images displayed therein, as well as their function in the course of playing the game of the present invention, will be described in detail later.

Below liquid crystal display 6, there are disposed a medal entry slot 7 where medals of game media are inserted, a spin switch 8 for starting the rotatable display elements mentioned above by button-pushing operation as an alternative to the actuation of start lever 5, a 1-BET switch 9 for betting only one medal credited on a game to allow a one-time button-pushing operation, a maximum BET switch 10 for betting maximum numbers of medals that can be bet on one time of game, and a C/P switch 11 for changing credit/payout of medals acquired by the player as a result of the button-pushing operations. Beneath the front face of cabinet 2 there is provided a medal tray 13 for saving medals paid out via a medal chute 12 in response to the actuation of C/P switch 11.

Figure 2:
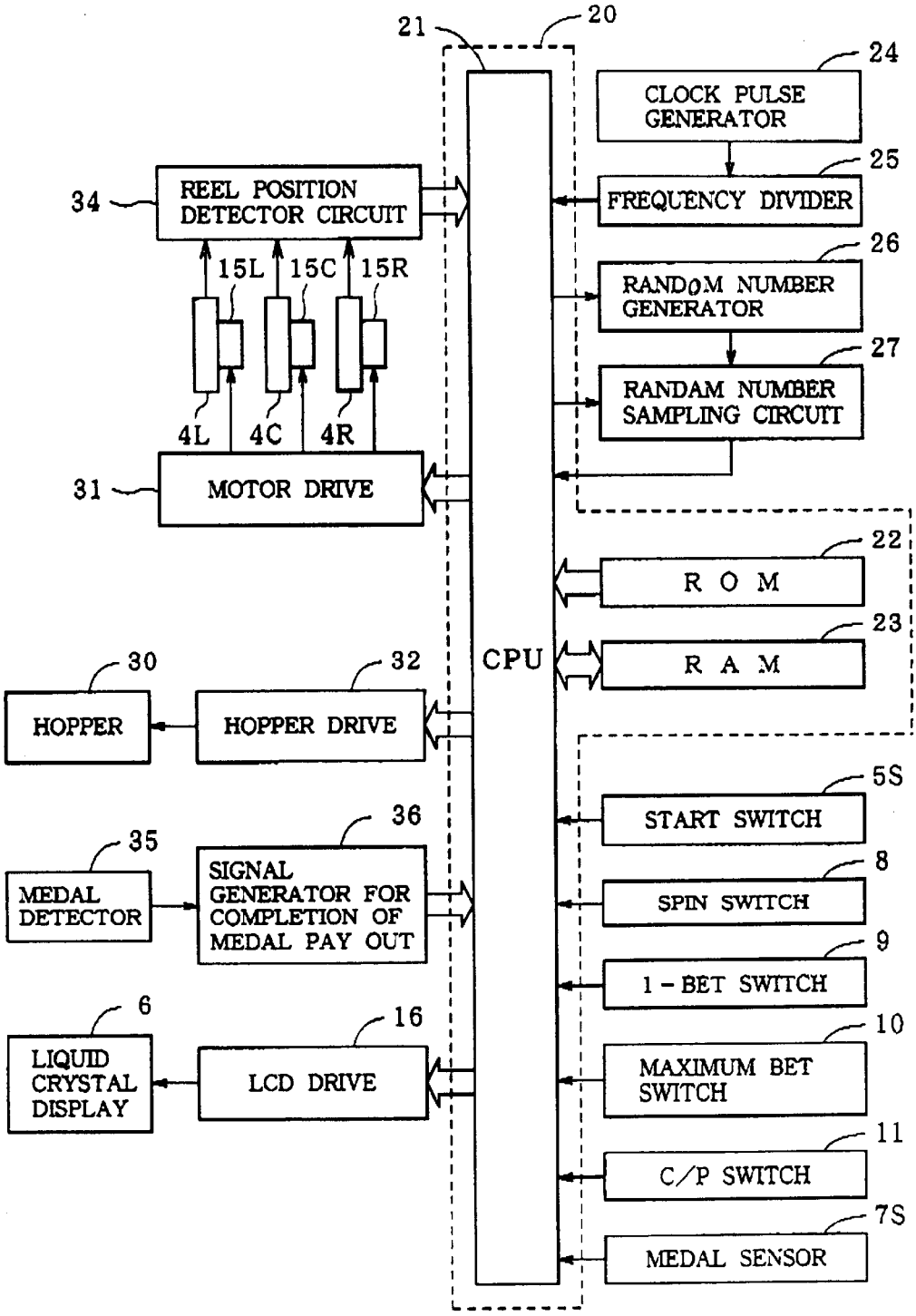
FIG. 2 is a function block diagram that illustrates the arrangement of a circuit used in the slot machine of FIG. 1.

FIG. 2 is a function block diagram that illustrates the methodology and arrangement of logic circuitry (not shown) that contains controllers for controlling the game procedure operations for slot machine 1, and peripheral equipment, i.e. actuators that are electrically connected thereto.

In this specific illustrative embodiment of the invention, control is effected by a microcomputer 20 and a random number sampling circuit 27 is coupled thereto. Microcomputer 20 includes a CPU 21 that executes control operations according to a preset program, and a ROM 22 and a RAM 23 as system memory. CPU 21 has connected thereto a clock pulse generator 24 for generating a reference clock pulse, a frequency divider 25, a random number generator 26 for generating random numbers to be sampled, and previously mentioned random number sampling circuit 27. The random number sampling may be executed in microcomputer 20, i.e. in an operation program of CPU 21. In such a case, random number generator 26 and random number sampling circuit 27 either would not be provided as discrete systems, or they would be used to backup the random number sampling operation.

In ROM 22 of microcomputer 20, in addition to the game control system for the slot machine, there are stored information and data necessary for executing procedures to indicate plural numbers of display images described later on the screen of liquid crystal display 6.

In FIG. 2, the operations are controlled by control signals from microcomputer 20. Stepping motors 15L, 15C, and 15R function as the main actuators for driving each of rotatable display elements 4L, 4C, and 4R mentioned above into rotation. A hopper 30 with a hopper drive 32 is provided for pay out. The hopper accommodates medals of game media. There is additionally provided the above-mentioned liquid crystal display 6 which is operated via a LCD drive 16. These subsystems are each connected to the outputs of CPU 21, and receive control signals therefrom.

Furthermore, the input signals necessary for microcomputer 20 to generate control signals are provided by medal sensor 7S that detects medals (not shown) that are inserted into medal entry slot 7. A start switch 5S detects the operations of start lever 5. Spin switch 8, 1-BET switch 9, maximum BET switch 10, C/P switch 11, rotatable display element position detector circuit 34 for receiving pulse signals from the rotatable display element rotation detector of the variable display and supplying signals for detecting the position of each rotatable display element to CPU 21, and signal generator 36 for completion of medal pay out supply signals to CPU 21 when the counted value of medal detector 35 for detecting medals paid out from hopper 30 reaches the predetermined number. These subsystems are connected to respective inputs of CPU 21.

In FIG. 2, random number generator 26 generates random numbers in a predetermined range of numerical values, and sampling circuit 27 samples one random number within a predetermined time period after start lever 5 has been operated. The random number thus sampled is evaluated to determine whether it pertains to the predetermined winning area stored in the memory portion of ROM 22, and if it does pertain to the winning area, a "wining request signal" is generated.

After rotatable display elements 4L, 4C, and 4R have been driven into rotation, the number of driving pulses supplied to each of stepping motors 15L, 15C, and 15R is counted, and the counted value is written in a predetermined area (not shown) within RAM 23. A reset pulse is delivered from rotatable display elements 4L, 4C, and 4R during every rotation, and these pulses are provided to CPU 21 via rotatable display element (reel) position detector circuit 34. CPU 21 clears the counted value of the driving pulses stored in RAM 23 to "0" by a reset pulse delivered in this manner. Thus, the counted value corresponding to a rotation position in a range of one rotation with respect to each of rotatable display elements 4L, 4C, and 4R is stored within RAM 23.

A symbol table (not shown) is stored within ROM 22 and contains the rotation positions of rotatable display elements 4L, 4C, and 4R, and the symbols (not shown in this figure) are correlated to such rotational positions. In addition, a winning symbol combination table is stored within ROM 22. In this winning symbol combination table are stored data corresponding to the winning symbol combinations, the numbers of medals of dividend for winnings, and the winning determination codes that represent the winnings. The winning symbol combination table is accessed when control over rotatable display elements 4L, 4C, and 4R is being executed, and the winning confirmation is executed after all rotatable display elements have been stopped.

In addition, within ROM 22, there are stored a program for executing the procedures to display "routine pattern" described hereinafter on liquid crystal display 6 before a "winning request signal" is generated and to display a "demonstration pattern" after a "winning request signal" is generated; the data of plural display images containing routine patterns and demonstration patterns; and the data that shows the references for selecting the image that should be displayed out of these.

Figure 3:
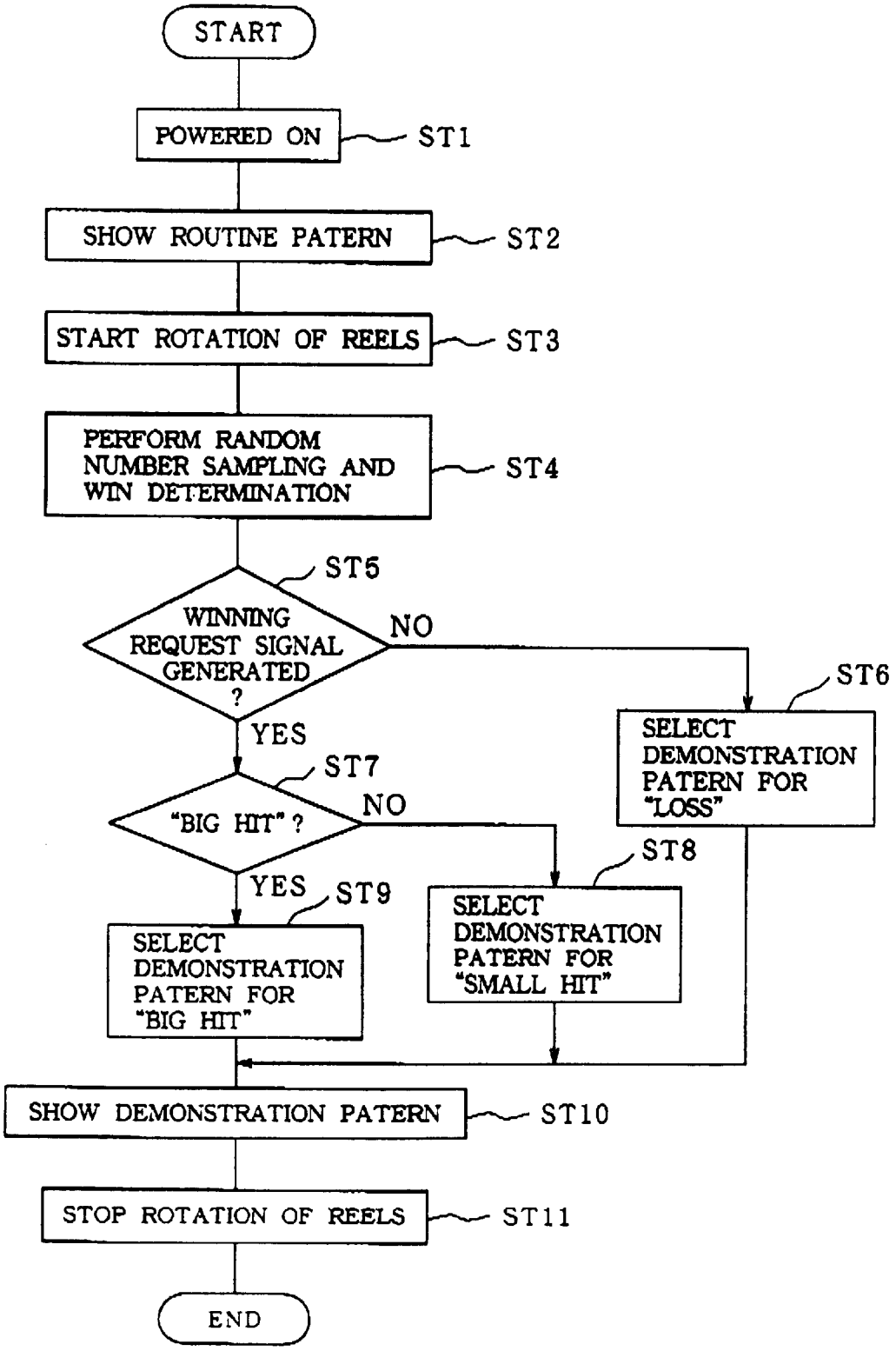
FIG. 3 is a flow chart that illustrates a portion of the control operation of the invention.

FIG. 3 is a flow diagram that illustrates a procedure for the operation that controls liquid crystal display 6. This procedure is executed by CPU 21 of microcomputer 20, which also functions as the game controller of slot machine 1. However, when the display, as does liquid crystal display 6, is provided with a CPU as a display controller, such a CPU may be used to determine the display image according to the display command from CPU 21 (e.g., the display command corresponding to the type of winnings or losses).

Referring to FIG. 3, in the beginning when the power supply of the gaming machine (slot machine 1) is powered up (step ST1), the CPU causes liquid crystal display 6 to show a "routine pattern" (ST2). When the player (not shown) operates start lever 5 or spin switch 8 after inserting medals into medal entry slot 7; or operating 1-BET switch 9; or operating maximum BET switch 10; rotatable display elements 4L, 4C, and 4R are caused to rotate, and the variable display is started (ST3). At this time, the determination of winning/unwinning is executed based on the random number extracted by random number sampling (ST4). It is then determined whether or not a "winning request signal" is generated (ST5), and the display image is determined according to the result of the determination. In other words, if a "winning request signal" is not generated, the specific demonstration pattern is selected out of the demonstration pattern group for "loss" (ST6). When a "winning request signal" is generated, it is determined at step (ST7) whether or not the "winning request signal" corresponds to a "big hit."

If the determination is "NO," the specific demonstration pattern for "small hit" is selected out of the demonstration pattern group for "small hit" (ST8). If it is "YES," the specific demonstration pattern for the "big hit" is selected out of the demonstration pattern group for the "big hit" (ST9). The demonstration pattern group (i.e., the demonstration pattern group for "loss," the demonstration pattern group for "hit," and the demonstration pattern group for "big hit") is formed by plural demonstration patterns respectively, and stored within ROM 22. Liquid crystal display 6 indicates the selected pattern in step (ST10), and executes the stop control corresponding to the winning request signals with regard to rotatable display elements 4L, 4C, and 4R during the rotation (ST11). The process then terminates at END.

In the procedure mentioned above, the variable display of ST3 is effected by CPU 21 supplying driving signals to motor drive 31, thereby driving stepping motors 15L, 15C, and 15R, and rotating rotatable display elements 4L, 4C, and 4R. In addition, the winning determination of ST4 is realized by a random number that, as stated, is sampled from random number generator 26 and the value of the random number thus extracted is evaluated to determine the group to which it belongs, as set forth above, in the winning probability table. Then, if the number was determined to be a winning number, CPU 21 delivers signals for controlling to stop rotatable display elements 4L, 4C, and 4R as the symbol display positions that corresponding to the kind of winnings, to motor drive 31. Control over stopping at step ST11 is thus realized.

CPU 21 executes an operation to deliver rotatable display element stop control signals based on the winning determination mentioned above to motor drive 31, and an operation to deliver pattern display signals based on the selection of the "demonstration pattern" that will be presented on liquid crystal display 6, to LCD drive 16 simultaneously Therefore, while the rotatable display elements (reels) are controlled to stop, the demonstration patterns are displayed on liquid crystal display 6. The "demonstration pattern" will be described in detail later.

When the number is determined to be a winning number, CPU 21 supplies medal pay out command signals corresponding to the kind of winnings to hopper drive 32, and executes the pay out of predetermined numbers of medals from hopper 30. At that time, medal detector 35 counts the number of medals paid out from hopper 30, and when the counted value reaches the predetermined number data, the signal generator for completion of medal pay out 36 inputs signals for completion of medal pay out into CPU 21. CPU 21 stops the drive of hopper 30 via hopper drive 32, thereby completing the procedure of paying out medals.

As described above, in slot machine 1, the CPU determines the generation of a "winning request signal," and executes the stop control of rotatable display elements 4L, 4C, and 4R so that the predetermined symbols of the "big hit" or the "small hit" are stopped on the winning line, or the symbols of "loss" stand in line according to the result. In addition, it controls liquid crystal display 6 to indicate demonstration patterns whereby players can expect the generation of "big hit," "small hit" or "loss."

On the other hand, when liquid crystal display 6 itself possesses a CPU as a display controller, CPU 21, as the game controller, delivers a command to have liquid crystal display 6 indicate the demonstration patterns whereby players can expect the generation of "big hit," "small hit" or "loss" to CPU of liquid crystal display 6, when it executes the rotatable display element stop control as mentioned above. According to this, CPU of liquid crystal display 6 determines the display image, and indicates it an the screen.

Figure 4:
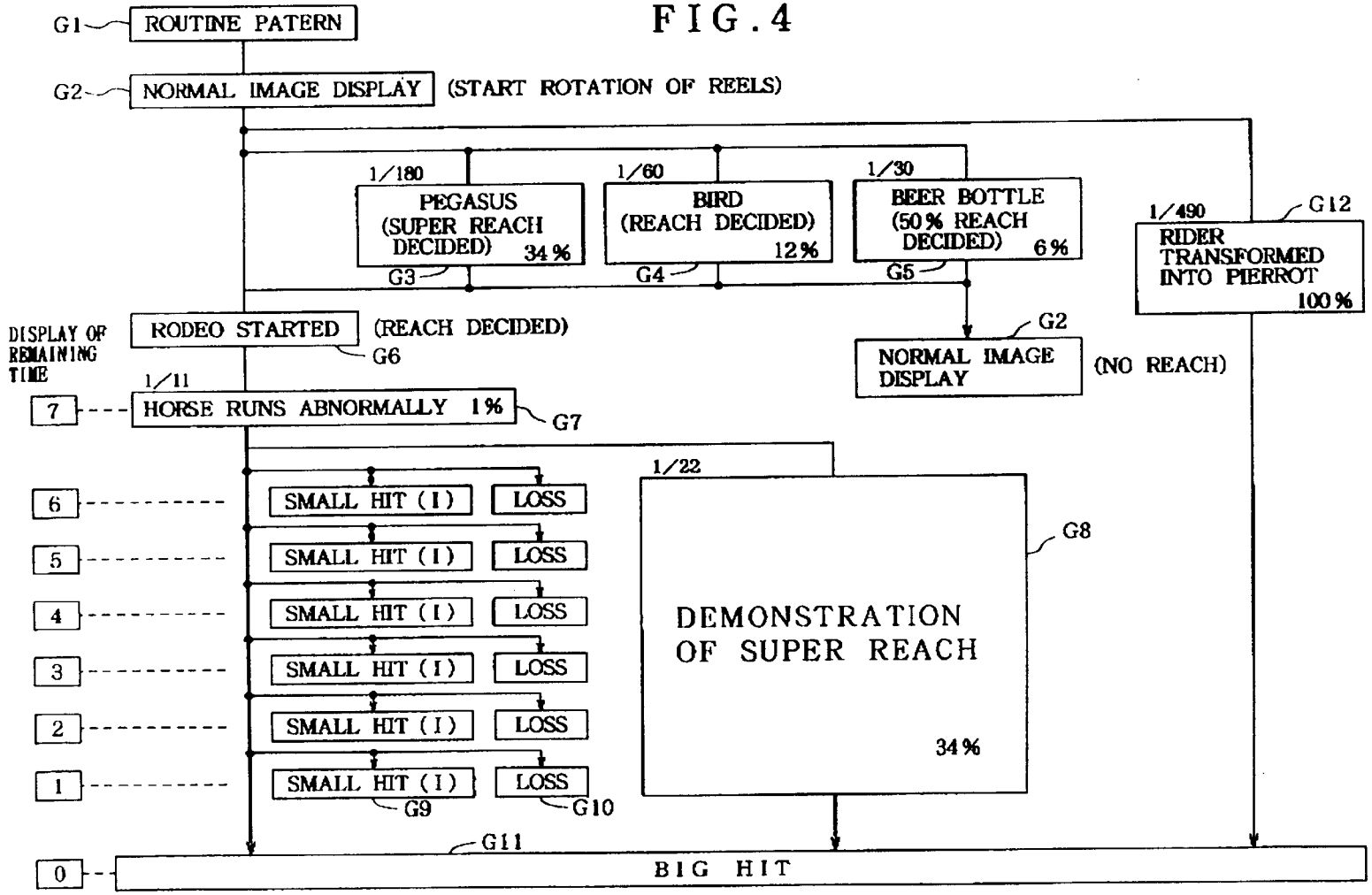
FIG. 4 is a flow chart of the display images of the liquid crystal display.
Figure 5:
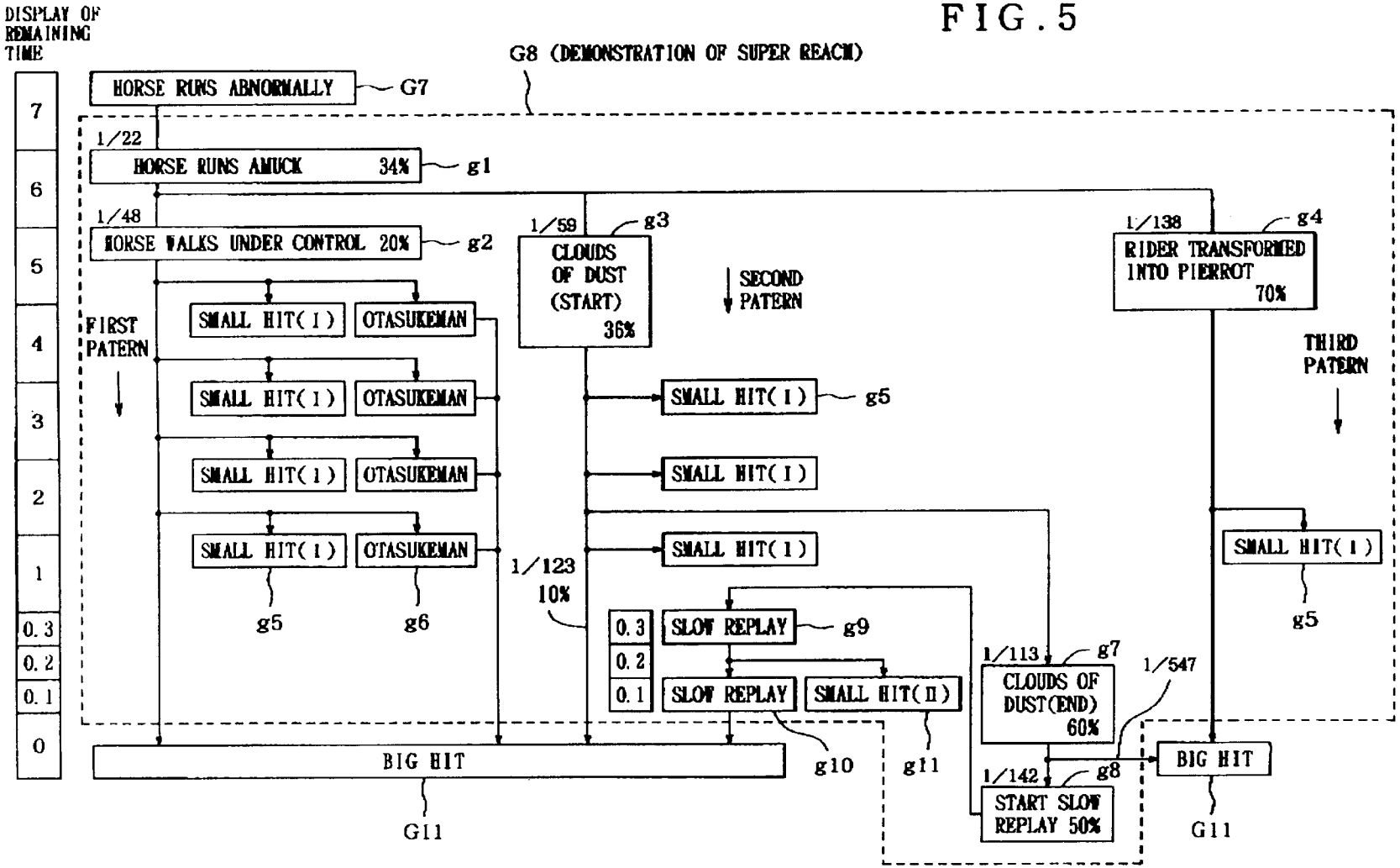
FIG. 5 is a flow chart of the displays of "super reach" screen presentations.

FIGS. 4 and 5 represent the transitions of displays with respect to "routine pattern" and "demonstration pattern" indicated on the screen of liquid crystal display 6. FIGS. 6–27 represent display states in display windows 3L, 3C, and 3R of rotatable display elements 4L, 4C, and 4R and examples of display images of liquid crystal display 6. The display of display windows 3L, 3C, and 3R becomes winning if the specific symbols are stopped along the winning line 14 arranged in the center of display windows 3L, 3C, and 3R when the rotation of rotatable display elements 4L, 4C, and 4R has been stopped.

Figure 6:
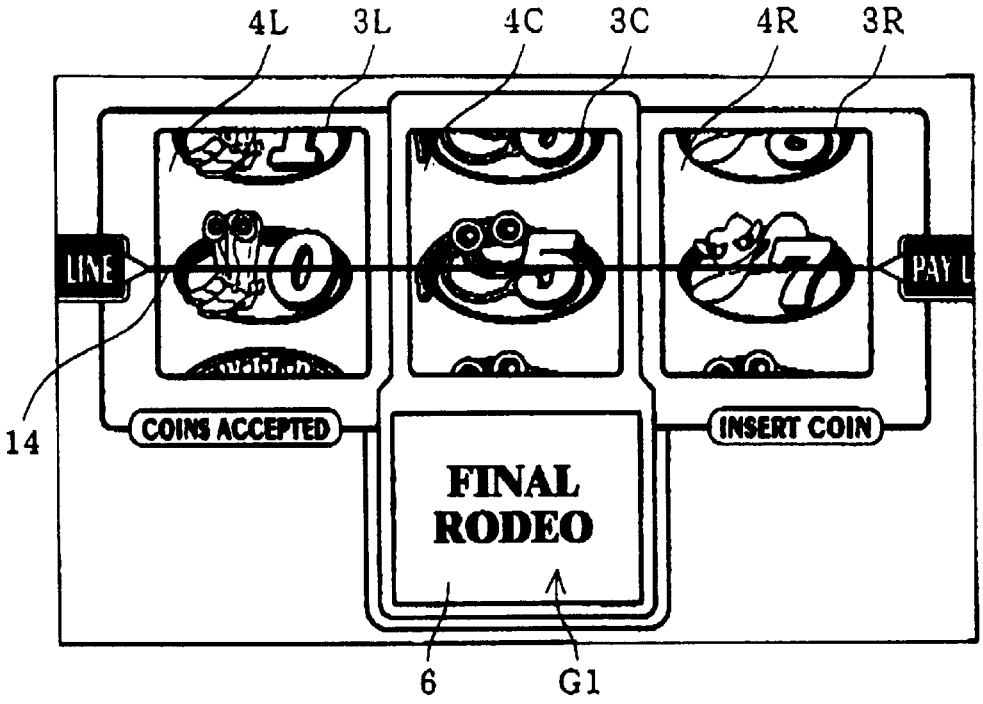
FIG. 6 is a representation that illustrates a display state before the variable display starts and an example of display images of the liquid crystal display of the embodiment of the invention.

FIG. 6 represents a display state in display windows 3L, 3C, and 3R before rotatable display elements 4L, 4C, and 4R start to rotate, and an example of display images of liquid crystal display 6. "The title of the game," is an example of a routine pattern that is displayed on liquid crystal display 6 (G1). In addition, in this routine pattern (G1), there are displays of "the explanation of the game" or "the explanation when a "reach" is generated." When the routine pattern has these plural images, they may be indicated successively at certain intervals.

Figure 7:
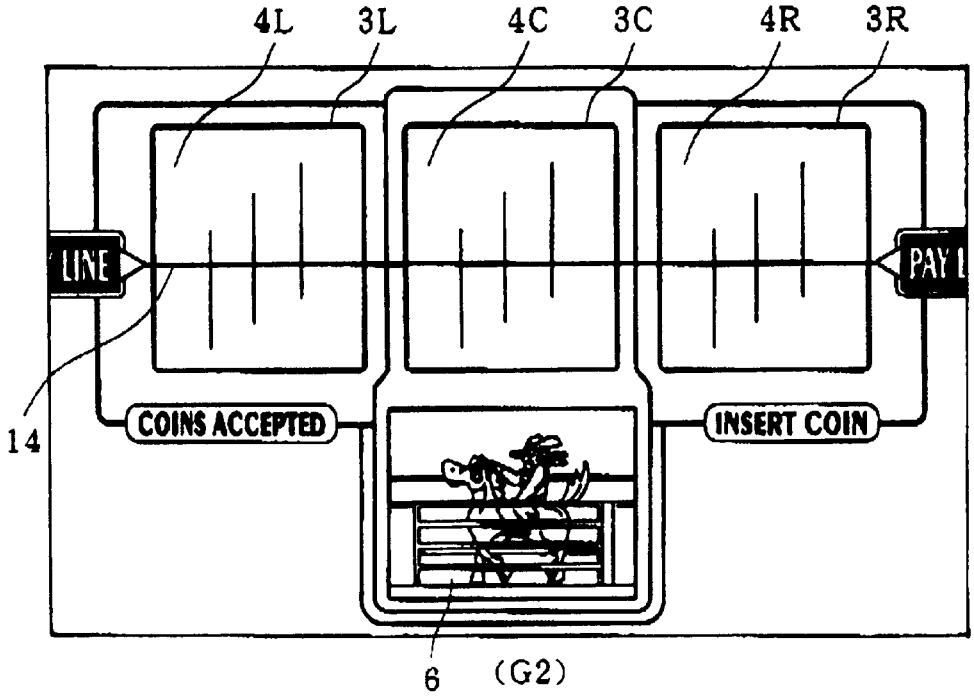
FIG. 7 is a representation that illustrates a display state after the variable display has started and a display image of the liquid crystal display.

FIG. 7 represents a display state in display windows 3L, 3C, and 3R just after rotatable display elements 4L, 4C, and 4R have started the rotation. The figure further shows an example of a display image on liquid crystal display 6. On liquid crystal display 6, the routine pattern disappears and the normal image display (G2) that "a cowboy who sat astride a horse" is displayed. When the color of the background is changed without disappearing the routine pattern of liquid crystal display 6 just after the rotation of rotatable display elements 4L, 4C, and 4R has started, this serves as a demonstration effect for representing the start of the game. In addition, after rotatable display elements 4L, 4C, and 4R has started rotating, during the predetermined time before the display of demonstration patterns is commenced on liquid crystal display 6, the demonstration effect enhances the feeling of tension in the player(s) (not shown) at the start of the game, notwithstanding that no image is indicated on liquid crystal display 6.

Figure 8:
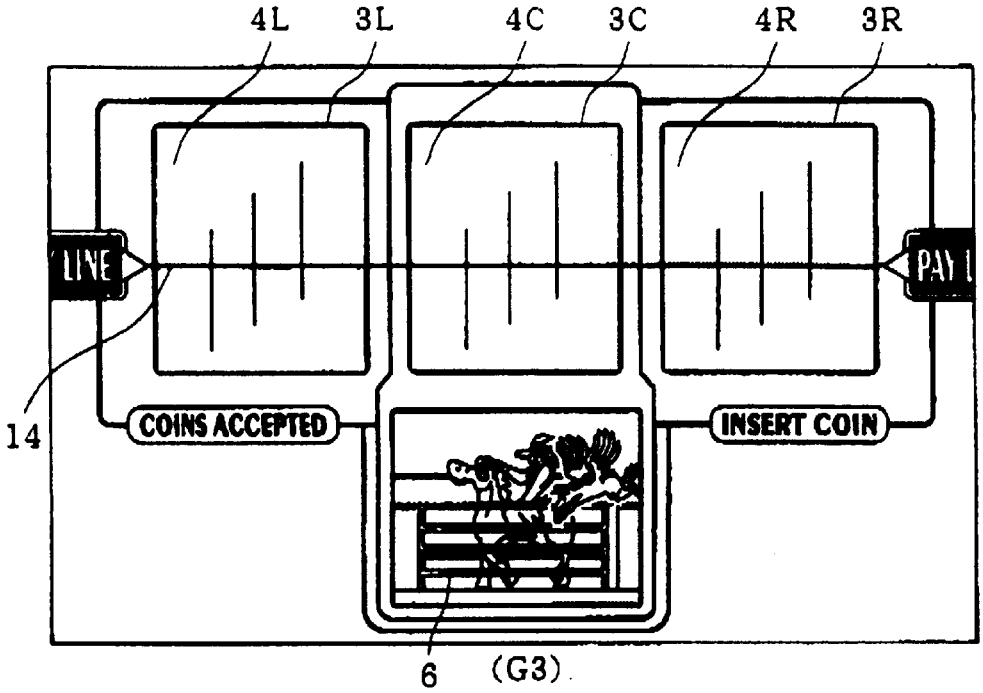
FIG. 8 is a representation that illustrates a display state after the variable display has started and the time when "Pegasus" appeared on the display image of the liquid crystal display.
Figure 9:
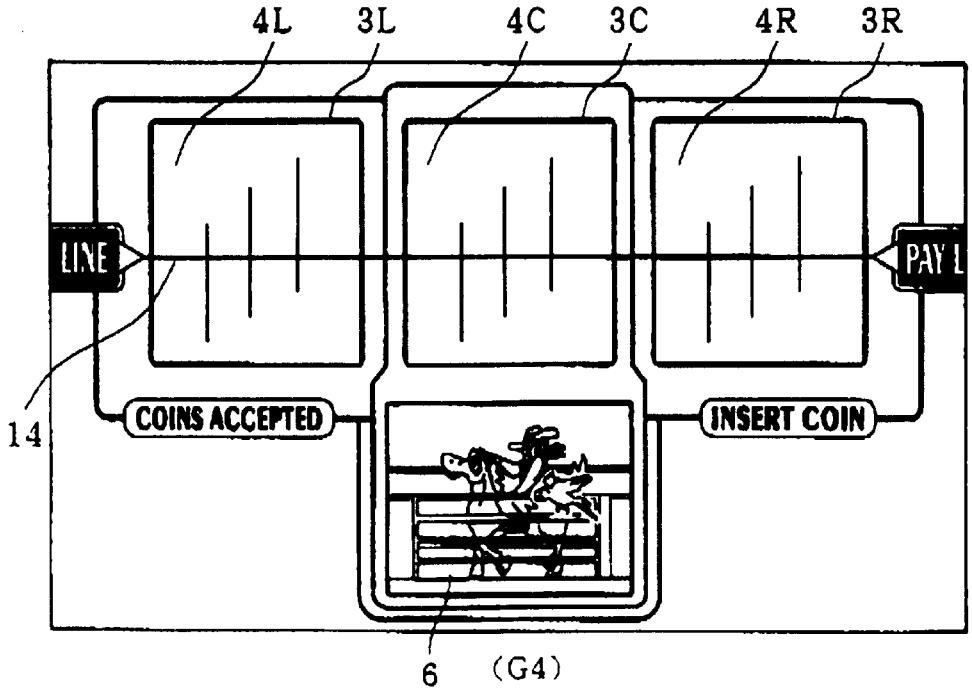
FIG. 9 is a representation that illustrates a display state after the variable display has started and the time when "a bird" appeared on the display image of the liquid crystal display.
Figure 10:
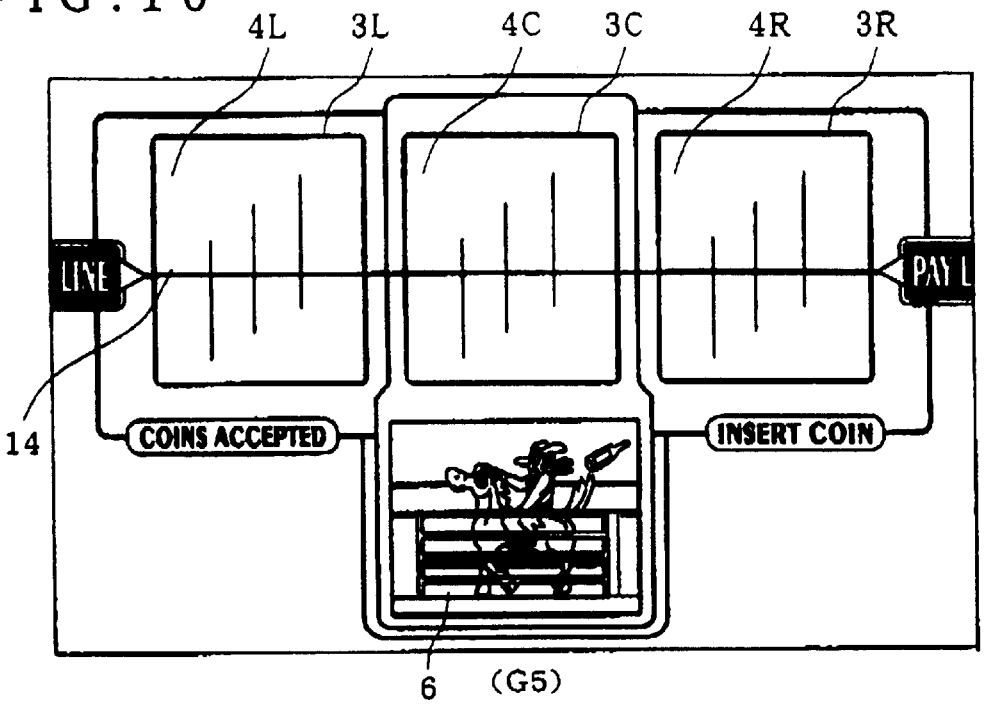
FIG. 10 is a representation that illustrates a display state after the variable display has started and the time when a "beer bottle" appeared on the display image of the liquid crystal display.

FIGS. 8–27 illustrate examples of demonstration patterns that are successively displayed on liquid crystal display 6. After the predetermined time of indicating the "normal image display" (G2), any of "Pegasus" as, shown in FIG. 8, "a bird" as shown in FIG. 9 or "a beer bottle" as, shown in FIG. 10 appears first on the "normal image display" (G3–G5). These images are all notice displays for announcing appearance of the "reach" state. The "reach" state means that two specific symbols are stopped in any two of display windows 3L, 3C, and 3R. The appearance of the image of a "beer bottle," as shown in FIG. 10 (G5), indicates in this specific illustrative embodiment of the invention that a "reach" state will appear with a probability of 50%, and the image that "a bird" as shown in FIG. 9 appears (G4) announces that the appearance of a "reach" state is decided at the probability of 100%. Further the appearance of the image of "Pegasus," as shown in FIG. 8 (G3), announces that the "super reach," which will be described hereinafter, has been determined with the probability of 100% after a "reach" state has appeared.

Figure 11:
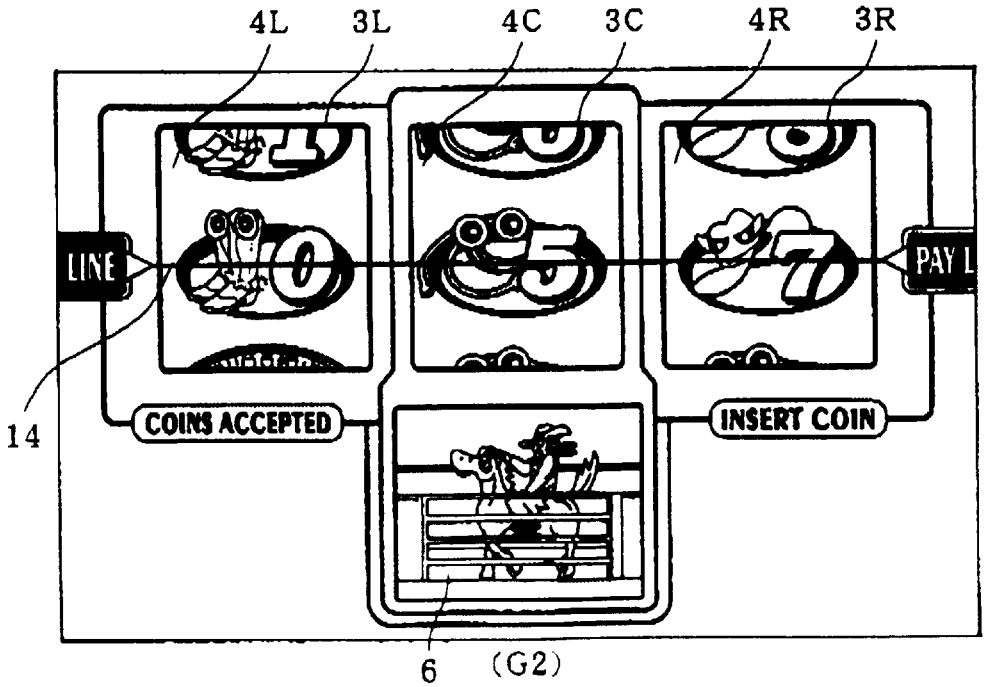
FIG. 11 is a representation that illustrates a display state when the variable display has stopped without "reach" demonstrations and a display image of the liquid crystal display.
Figure 12:
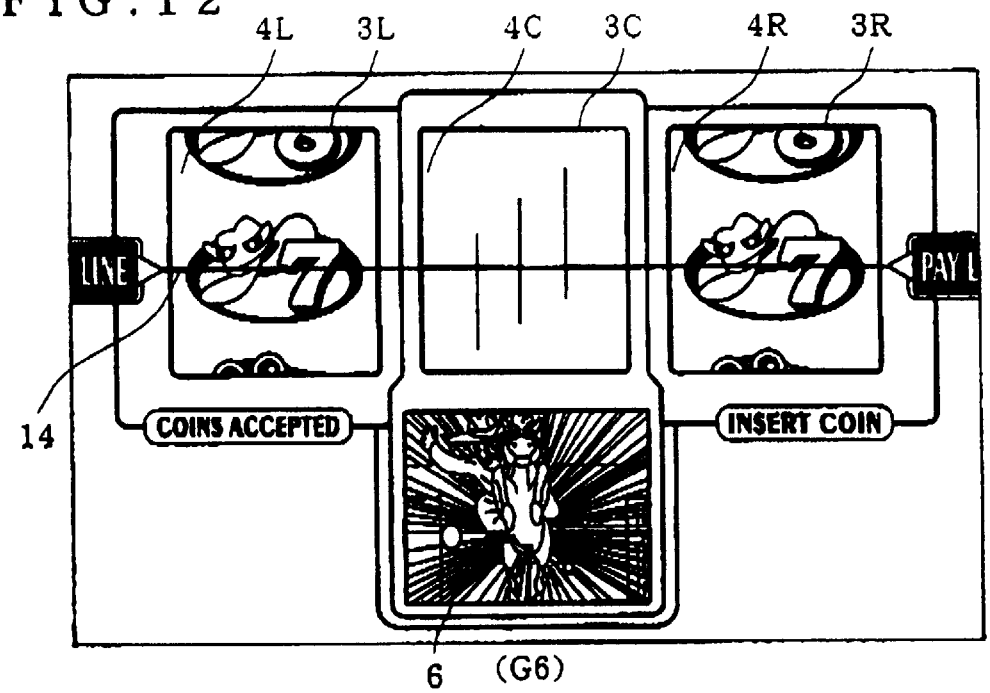
FIG. 12 is a representation that illustrates the time when the variable display has indicated a "reach" state, and when the image that represents a "reach" decision is indicated on the display screen of the liquid crystal display.

FIG. 12 shows a display state in display windows 3L, 3C, and 3R when the rotation of right and left rotatable display elements, 4L "and 4R have stopped, and represents the "reach" state at the specific symbols "7s" are stopped in the right and left portions of the display. In this case, liquid crystal display 6 indicates the "rodeo started" image (G6) that has the depiction of "a horse runs uncontrollably." However, in the case when the display state in display windows 3L, 3C, and 3R does not become a "reach" state when the rotation of right and left rotatable display elements, 4L and 4R has stopped, it returns to the above-mentioned "normal image display" (G2), as shown in FIG. 11.

In this case, the reason why rotatable display element 4C is set to stop last as for the stop control of the rotation of rotatable display elements 4L, 4C, and 4R is to express a sense of unity of the display image of liquid crystal display 6 and the stop result of the rotatable display elements, because liquid crystal display 6 is arranged centrally.

Figure 13:
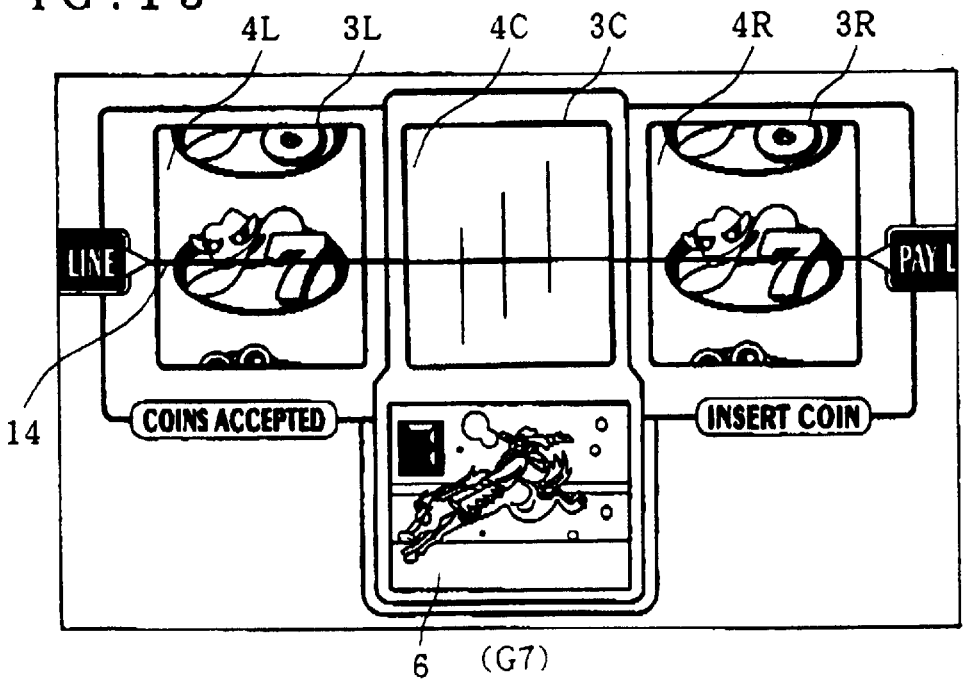
FIG. 13 is a representation that illustrates the time when the variable display has indicated a "reach" state, and when the "horse runs abnormally" image is indicated on the display screen of the liquid crystal display.
Figure 14:
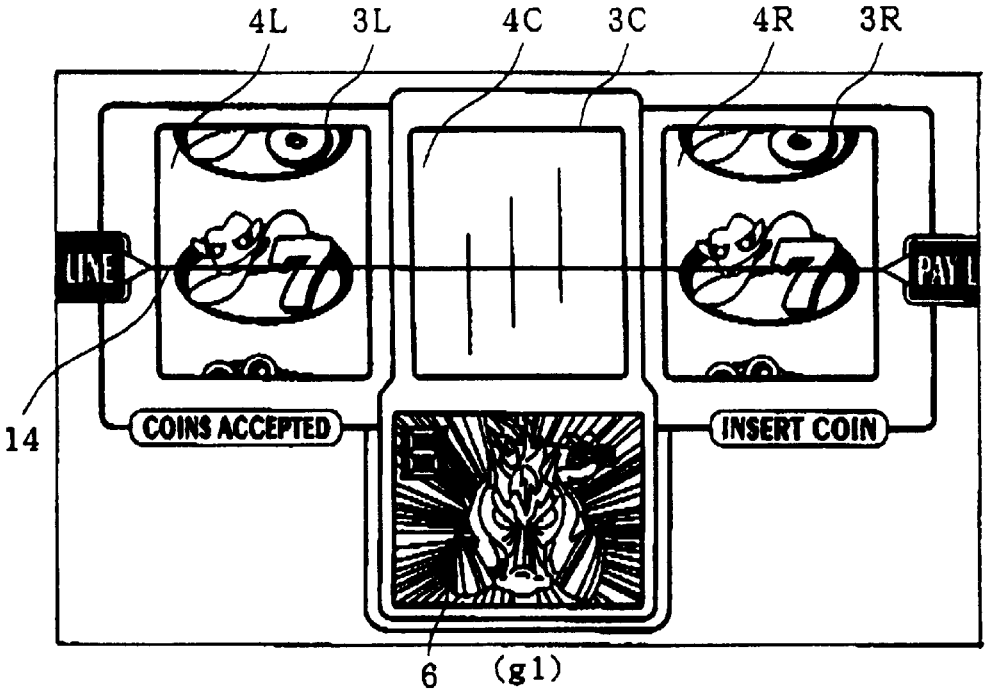
FIG. 14 is a representation that illustrates the time when the variable display has indicated a "reach" state, and when the image that represents the start of a "super reach" demonstration is indicated on the display screen of the liquid crystal display.
Figure 27:
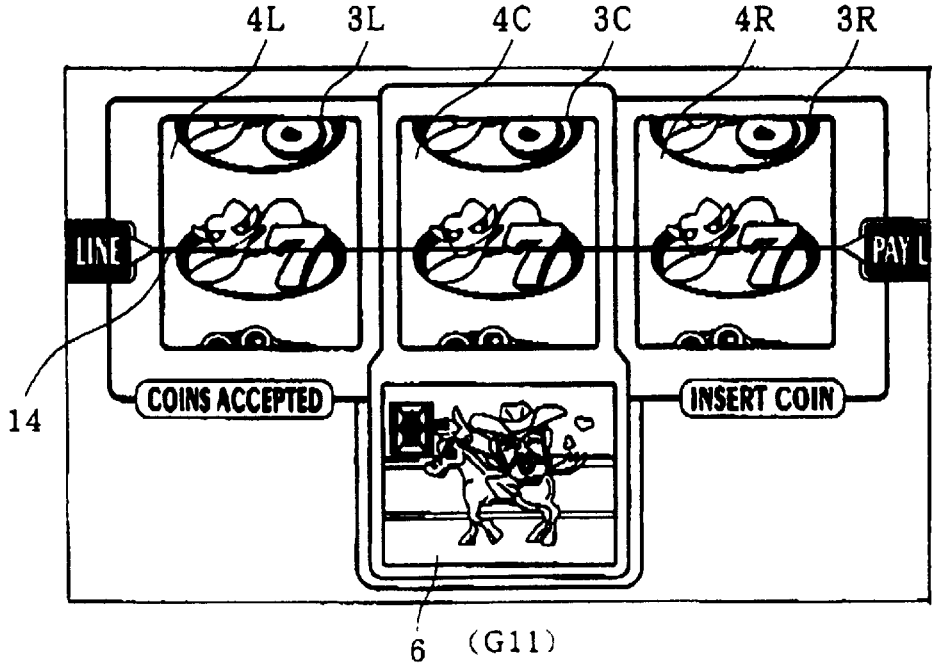
FIG. 27 is a representation that illustrates the time when the variable display has indicated the symbols that would become "big hit" when the display has stopped, and when the image corresponding to it is indicated on the display screen of the liquid crystal display.

Next, the "horse runs abnormally" image (G7) of the state that "a cowboy fights with an unruly horse" as shown in FIG. 13 is indicated after the predetermined time of indicating the rodeo started image (G6). Then, the numeral "7"is displayed in the left upper location of the screen of liquid crystal display 6. This represents the remaining time (second) that the display in display windows will become "big hit" when the rotation of central rotatable display element 4C has stopped. "Big hit" represents the state that the combination of stop symbols "7"-"7"-"7" is stood in the winning line 14 in display windows as shown in FIG. 27. Therefore, if this numeral is indicated to count down to "0," that is, if the cowboy who mounted an unruly horse rides it out for seven seconds, it becomes "big hit."

The specific pattern, "super reach" (G8) is determined to be demonstrated on the screen of liquid crystal display 6 after the "horse runs abnormally" image (G7) has been displayed. Transition of the display of the "super reach" presentation is shown in FIG. 5. This "super reach" presentation ensures generation of a winning display state in any kinds without generation of loss display state in display window 3L, 3C, 3R at the time of stop of rotation of every rotatable display element. Accordingly, the player can watch carefully successive development of images with increasing expectation of a "big hit." Therefore, since the image (G3) in which "Pegasus" appears as in FIG. 8 described above predicts the "super reach" demonstration with 100% probability after appearance of the "reach" state, the player can recognize the development of a win condition before a "reach" state has been displayed.

"Super reach" demonstration (G8) is started upon the display of "face UP of horse running amuck" image (g1) (also display of remaining time of 6 (seconds) to generation of "big hit") after one second of display of the image (G7) of "horse runs abnormally." After the "face UP of horse running amuck" image (g1) is displayed for one second, the "super reach" demonstration is divided into three patterns.

Figure 15:
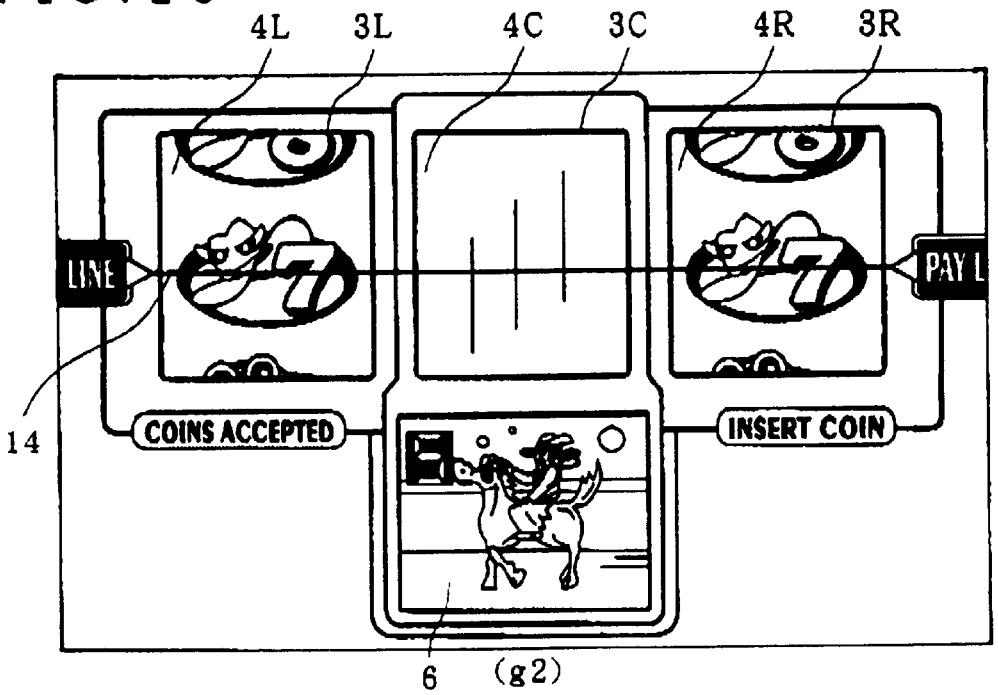
FIG. 15 is a representation that illustrates the time when the variable display has indicated a "reach" state, and when the "horse walks under control" image is indicated on the display screen of the liquid crystal display.
Figure 16:
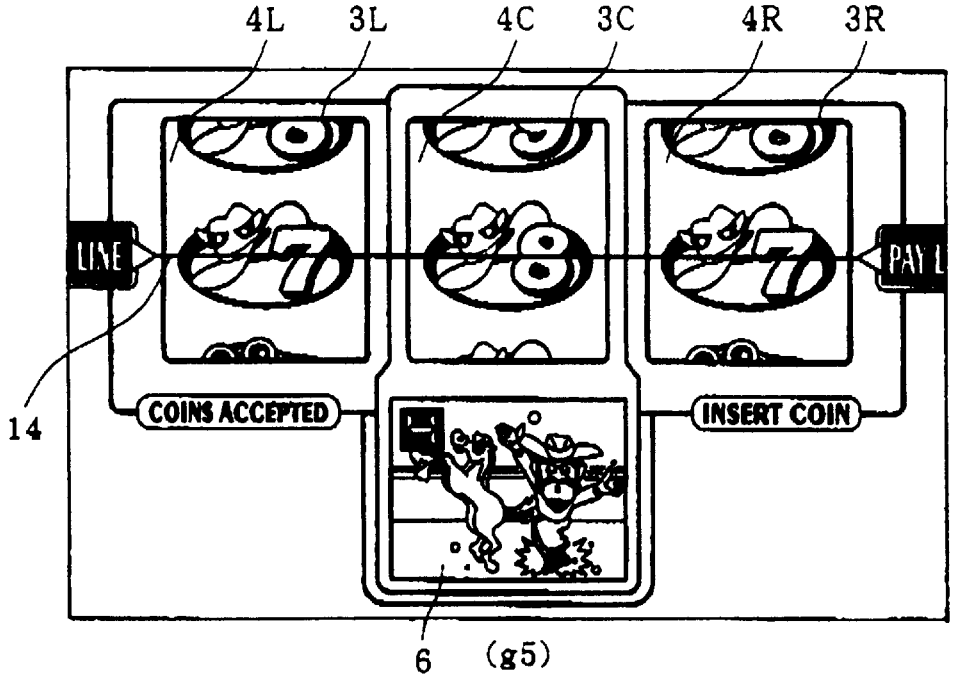
FIG. 16 is a representation that illustrates the time when the variable display has indicated the symbols that would become "small hit" when the display stopped, and when the image corresponding to it is indicated on the display screen of the liquid crystal display.
Figure 17:
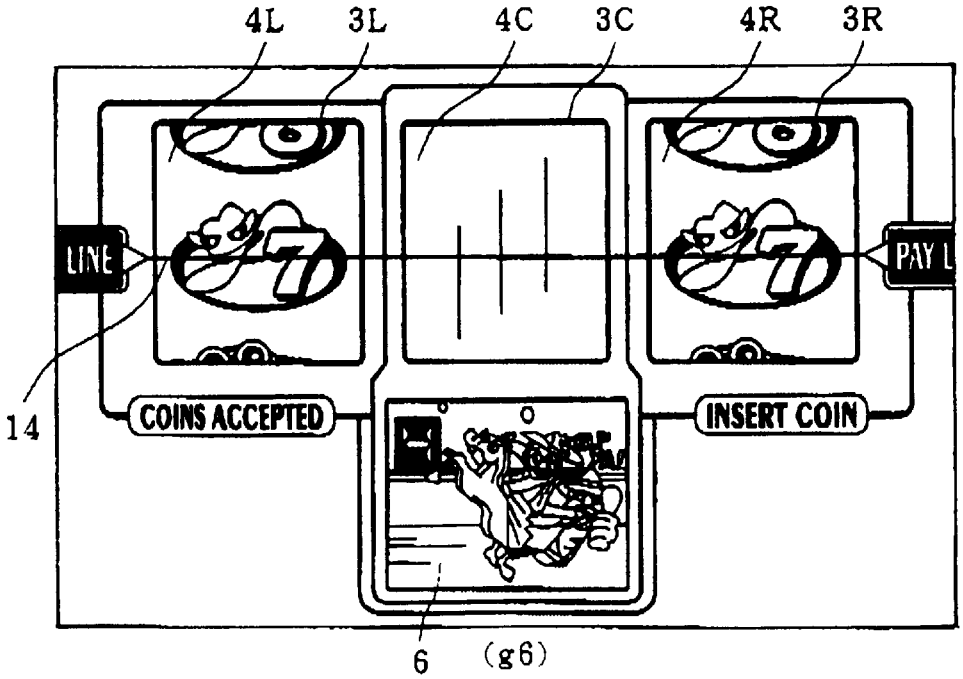
FIG. 17 is a representation that illustrates the time when the variable display has indicated a "reach" state, and when the "OTASUKEMAN (man who helps the cowboy) coming" image is indicated on the display screen of the liquid crystal display.

In the first pattern, as shown in FIG. 15, the "horse walks under control" image (g2) is displayed (also displayed remaining time of 5 (seconds) to generation of big hit), then during 4 seconds to 1 second of remaining time to generation of "big hit," as shown in FIG. 16, when the rotation of every rotatable display element has stopped and the "small hit"was decided by the stop symbols shown in display windows 3L, 3C, 3R, liquid crystal display 6 displays "cowboy landing" image (g5) corresponding to the "small hit" synchronized with the ceasing of rotation of central rotatable display element 4C to complete the game. If the "big hit" has been decided to be generated in display window 3L, 3C, 3R, as shown in FIG. 17, the "OTASUKEMAN coming" image (g6) is displayed until the generation of the "big hit," and then the "cowboy delighted" image (G11) is displayed on the liquid crystal display 6 in synchrony with the cessation of rotation of each rotatable display element (reel).

In this case, the "OTASUKEMAN coming" image (g6) can make the player change in feeling from a condition of tension generated by watching carefully whether the cowboy may fall from the horse or not during 5 seconds from display of "horse walks under control" image (g6) to display of "cowboy delighted" image (G11), to an emotional condition of relief immediately. The player can play the game while maintaining the expectation and relief by the presentations mentioned above. Also, the demonstration as described above adds and interest variety to the game, thereby enhancing the player's interest in the game.

Figure 18:
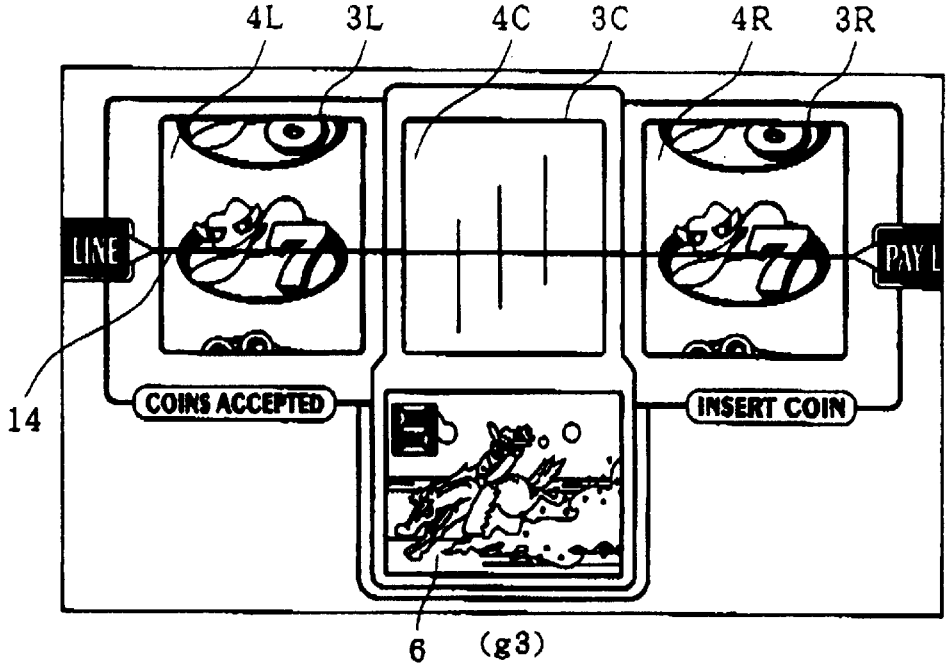
FIG. 18 is a representation that illustrates the time when the variable display has indicated a "reach" state, and when the "clouds of dust (start" image is indicated on the display screen of the liquid crystal display.

In the second pattern, at first the "cloud of dust (start)" image (g3) as shown in FIG. 18 is displayed (also remaining time of 5 (seconds) is displayed). Then, in the case where the "small hit" is determined to be displayed in the display windows 3L, 3C, 3R by cessation of the rotation of the central rotatable display element 4C, liquid crystal display 6 indicates a "cowboy landing" image (g5) symbolizing the "small hit" simultaneously with the cessation of the rotation of central rotatable display element 4C. The game is finished and the player acquires an award corresponding to the win.

Figure 19:
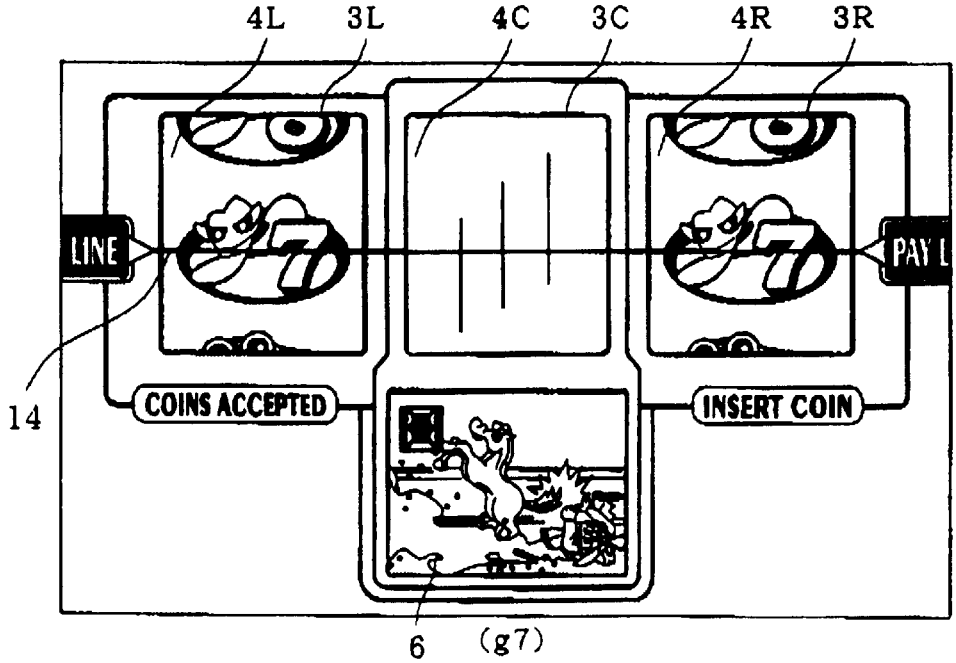
FIG. 19 is a representation that illustrates the time when the variable display has indicated a "reach" state, and when the "clouds of dust (end)" image is indicated on the display screen of the liquid crystal display.
Figure 20:
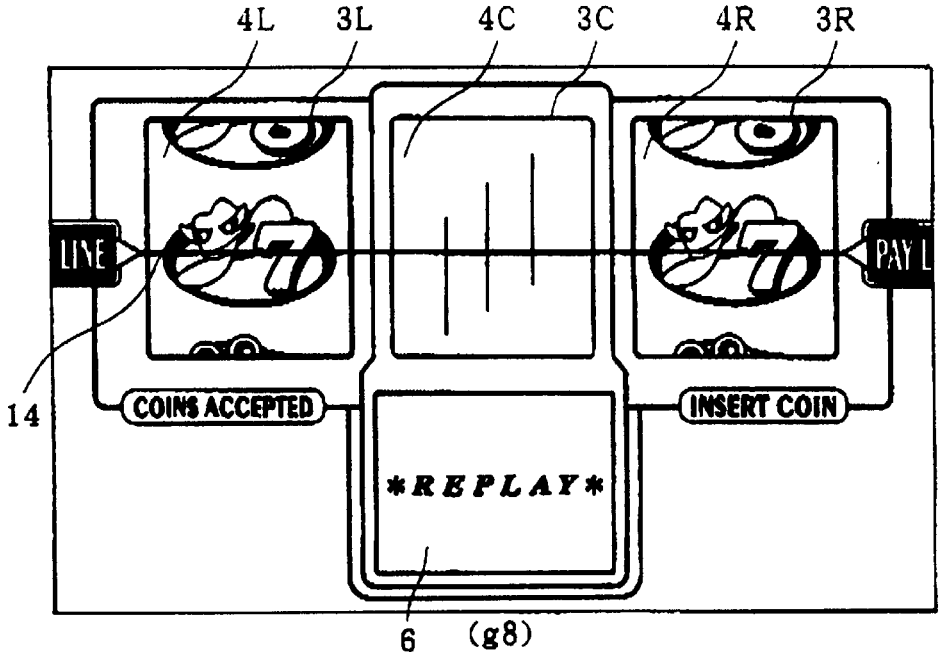
FIG. 20 is a representation that illustrates the time when the variable display has indicated a "reach" state, and when the image that informs the start of the slow motion replay is indicated on the display screen of the liquid crystal display.
Figure 21:
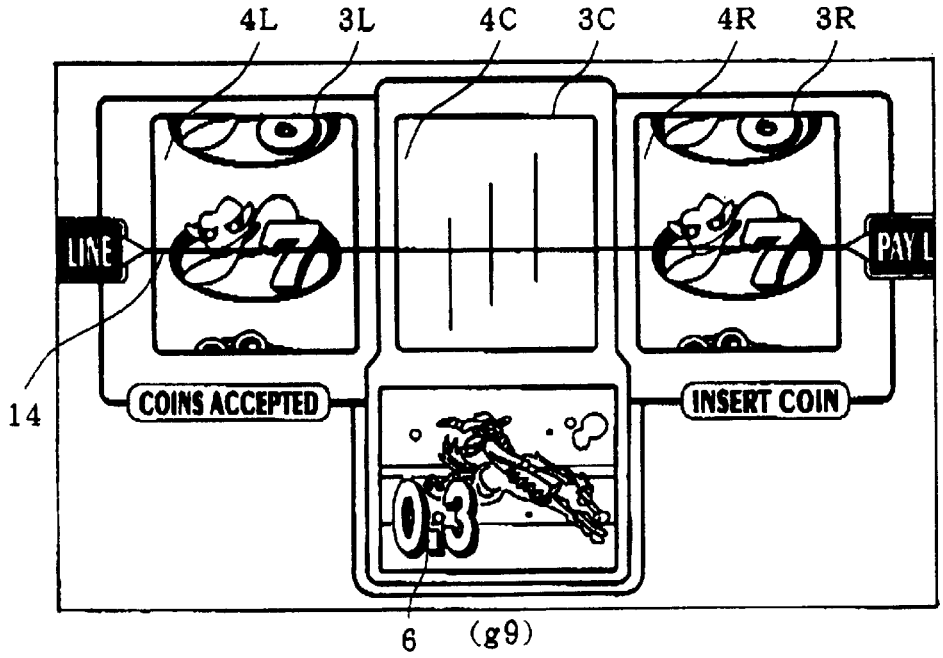
FIG. 21 is a representation that illustrates the time when the variable display has indicated a "reach" state, and when the first screen of the slow motion replay is indicated on the display screen of the liquid crystal display.
Figure 22:
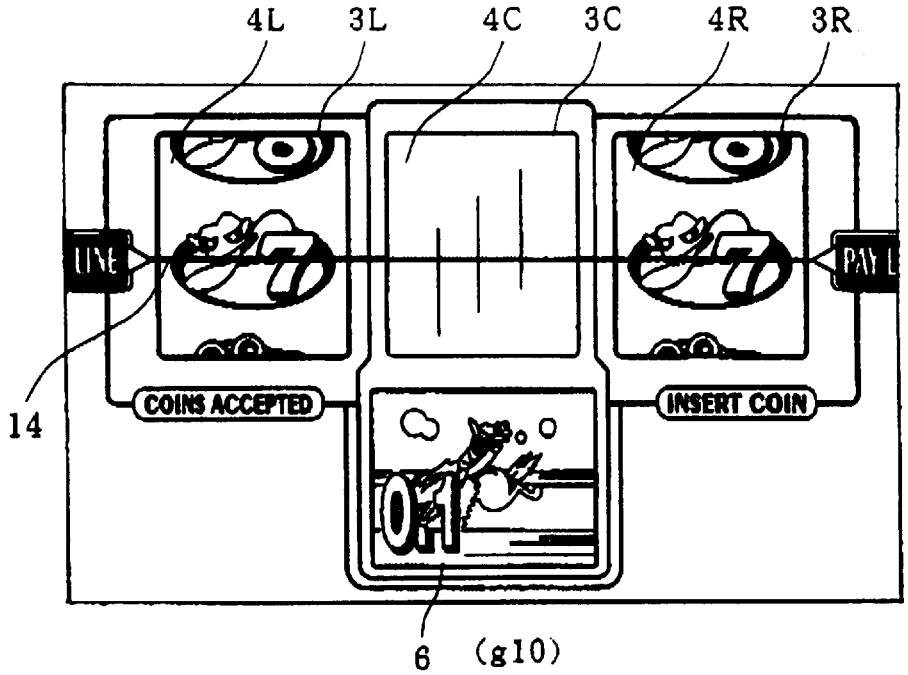
FIG. 22 is a representation that illustrates the time when the variable display has indicated a "reach"0 state, and when the screen appeared just before the end of the slow motion replay is indicated on the display screen of the liquid crystal display.

In the case where the remaining time to become the "big hit" has expired during the display of the "cloud of dust (start)" image (g3), at that moment (display of remaining time: 0), the "cloud of dust (end)" image (g7) as shown in FIG. 19 is displayed. Although the cowboy seems to have fallen from the horse according to the image as shown m FIG. 19, because this image is changed quickly, the player cannot determine whether or not he has won. However, the player can determine what kind of image finally will be displayed by the slow motion replay of rewound images that will be described later. Also, the slow motion replay of rewound images can change the emotional state of the player from discouragement by recognition of the "cloud of dust (end)" image (g7) that was shown as losing a win, to expectation.

The slow motion replay of rewound images performed in this example is: just after display of the "cloud of dust (end)" image (g7), at first the "start slow replay" image (g8), and then returning to the image displayed before 0.3 second of display of the "cloud of dust (end)" image (g7), replay of the rewound images is started.

Sometimes, as shown in FIG. 5, just before the "start slow replay" image (g8) is displayed, rotation of the central rotatable display element C is stopped to generate the "big hit" in display windows 3L, 3C, 3R and at the same time, the "cowboy delighted" image as shown in FIG. 27 is displayed in liquid crystal display 6, and the player can gain an award corresponding to the win.

Figure 23:
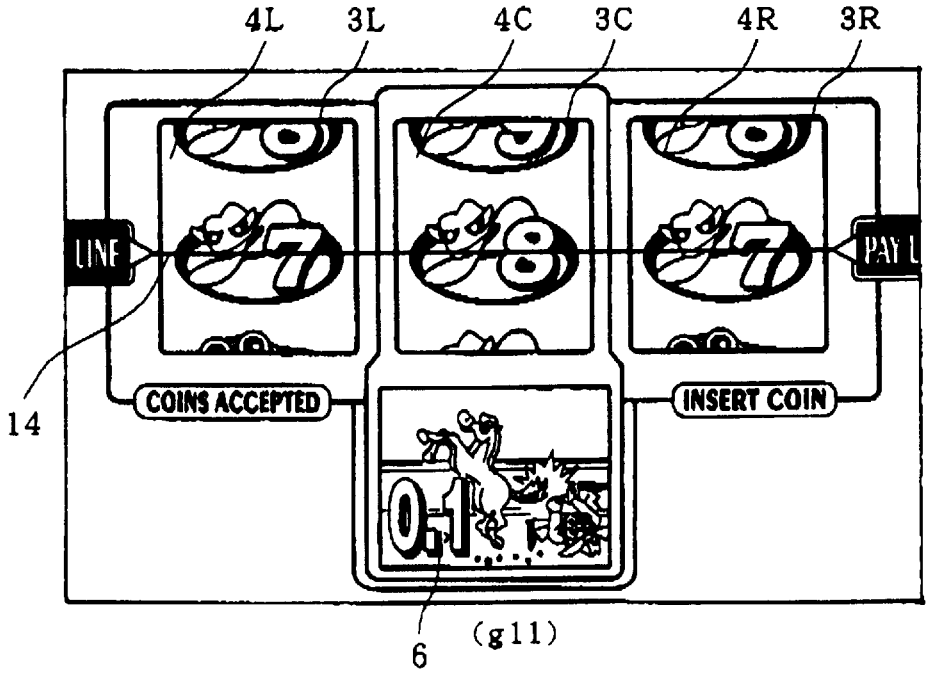
FIG. 23 is a representation that illustrates the time when the variable display has indicated the symbols that would become "small hit" when the display has stopped, and when the last screen of the slow motion replay corresponding to the variable display is indicated on the display screen of the liquid crystal display.

The replay of rewound images by slow motion display is performed in a manner that the images of the "cowboy fighting with an unruly horse" (g9) and (g10) are slowly replayed with simultaneous display of remaining time counting down by second until the "big hit" occurs, and as shown m FIG. 5, at the time of the remaining of 0.1, unless the game is finished in the manner that rotation of central rotatable display element 4C stops displaying the "small hit" in the display windows 3L, 3C, 3R and at the same time displaying the "cowboy falling from horse" image (g11) as shown in FIG. 23 in the liquid crystal display 6, at the moment that remaining time is over (display of remaining time 0), rotation of central rotatable display element 4C stops with the presentation the "big hit" in display windows 3L, 3C, 3R and at the same time, the "cowboy delight" image (G11) as shown in FIG. 27 is displayed in the liquid crystal display 6.

Figure 24:
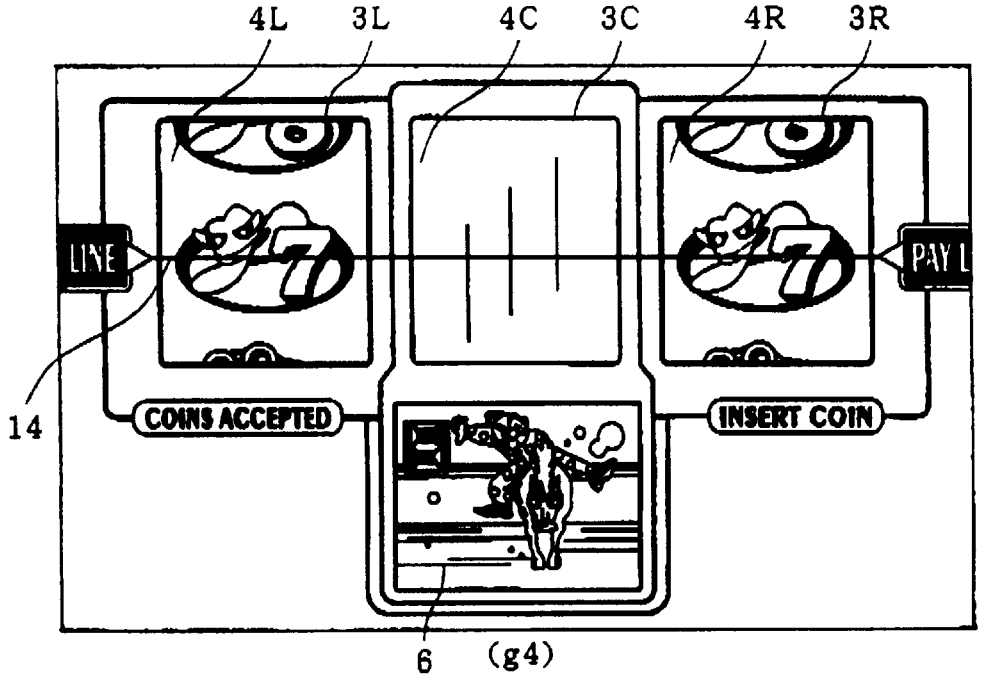
FIG. 24 is a representation that illustrates the time when the variable display has indicated a "reach" state, and when the "rider transformed into Pierrot" image is indicated on the display screen of the liquid crystal display.

In the third pattern, at first the "rider transformed into Pierrot" image (g4) as shown in FIG. 24 is displayed (remaining time of 5 (seconds) is also displayed). Then, unless during from 4 seconds to 1 second of remaining time to generation of the "big hit," as shown in FIG. 16, when rotation of every rotatable display element stopped the "small hit" is decided by the stop symbols shown in display windows 3L, 3C, 3R, there is displayed on liquid crystal display 6 the "cowboy landing" image (g5) corresponding to the "small hit" synchronized with the cessation of rotation of central rotatable display element 4C, thereby completing the game. By pay out of an award corresponding to the win, at the moment that remaining time is expired (display of remaining time: 0), rotation of central rotatable display element 4C stops with the display of the "big hit" in display windows 3L, 3C, 3R, and at the same time, the "cowboy delight" image (G11), as shown in FIG. 27, is displayed in liquid crystal display 6. Consequently the player obtains the award that corresponds to the win.

The explanation above is about three patterns of the "super reach" demonstration, and when the "super reach" demonstration appears in any pattern the game results in "hits" and never results in "loss." Therefore, if the image (g1) the "face UP of horse running amuck" that predict the "super reach" demonstration is displayed, the player watches development of the story on the display screen with a big expectation. However, even if the "super reach" demonstration has been decided, the "big hit" is not guaranteed. The "super reach" demonstration makes the player watch carefully until the game result is obtained, and therefore the interest of the player in the whole game is enhanced.

Figure 26:
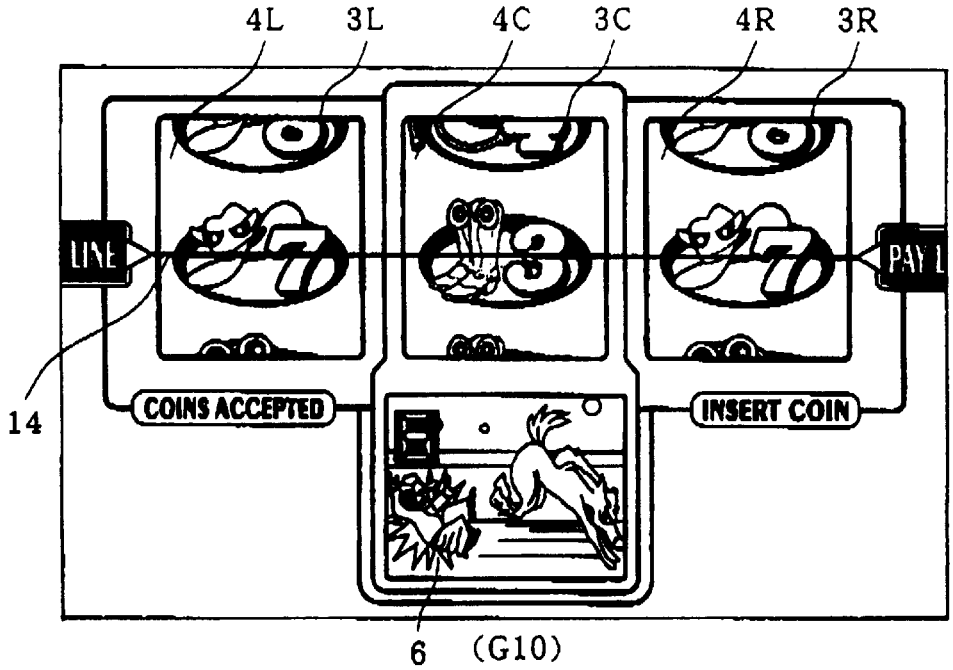
FIG. 26 is a representation that illustrates the time when the variable display has indicated the symbols that would become "loss" when the display has stopped and when the image corresponding to it is indicated on the display screen of the liquid crystal display.

In FIG. 4, the "super reach" demonstration is determined not to be displayed. Alter the image (G7) "horse runs abnormally" is displayed, if rotation of all rotatable display elements stops during 6 seconds to 1 second of the time remaining to generation of the "big hit," and the combination of symbols shown in the display window 3L, 3C, 3R means the "small hit," the "cowboy landing" image (g5) as shown in FIG. 16 is displayed in the liquid crystal display 6. On the other hand, if the combination of symbols shown in the display window 3L, 3C, 3R means "loss,"the "cowboy falls from horse" image (G10) as shown in FIG. 26 is displayed in the liquid crystal display 6. Also, the "big hit" is sometimes obtained directly after display of the "horse runs abnormally" image (G7) without demonstration of images on the liquid crystal display 6 described above. Consequently, according to the invention, the player can expect the "big hit" even when the demonstration is not performed.

Figure 25:
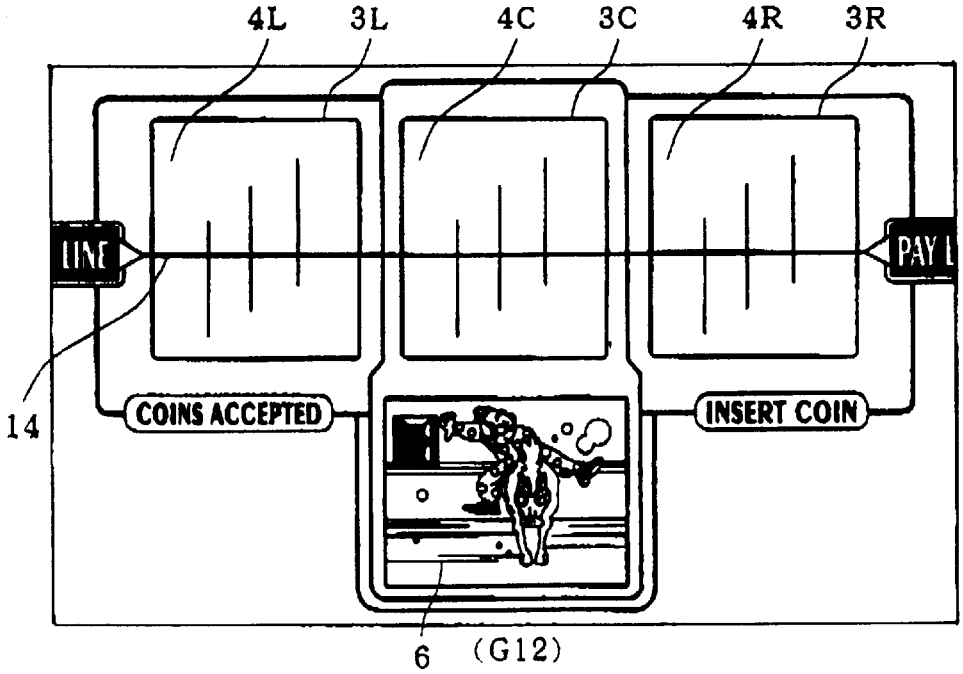
FIG. 25 is a representation that illustrates a display state after the variable display has started and the time when the "rider transformed into Pierrot" image is indicated on the display image of the liquid crystal display.

Further, if immediately after the display of the "normal image display," (G2) and before the predictive display (G3, G4 or G5) of appearance of any one of the "Pegasus," the "bird," and the "beer bottle," the "rider transformed into Pierrot" image (G12) as shown in FIG. 25 is displayed on the liquid crystal display 6, then rotation of every rotatable display element stops and the combination of symbols shown in display window 3L, 3C, 3R becomes the "big hit." At the same time, image (G11) the "cowboy delighted" as shown in FIG. 27 is displayed on the liquid crystal display 6, and the player gains an award corresponding to the win. In this case, as shown in FIG. 25, at the time when the image (G12) the "rider transformed into Pierrot" in FIG. 25 is displayed the player can recognize the occurrence of the "big hit" with 100% of probability.

Each image indicated by the liquid crystal display 6 has a different degree of expectation with respect to the occurrence of the "big hit." A value expressed by "%" in FIG. 4 and FIG. 5 indicates the degree of expectation in the occurrence of the "big hit" which is associated with each image. Accordingly, as the expectation degree changes, accompanied with the change of the images, it is possible to increase or decrease the expectation degree in the progression of the images. For example, at the time of display of the "face UP of horse running abnormally" image (g1), the expectation degree is 34%, but after some progress of image display, at the time of display of the "rider transformed into Pierrot" image (g4), the expectation degree increases to 70%. If the "horse walks under control" image (g2) is displayed, the expectation degree decreases to 20%. Even when the degree is increasing from 36% of the "clouds of dust (start)" image (g3) to 60% of the "clouds of dust (end)" image (g7), after then if the "start slow motion replay" image (g8) is displayed, the expectation degree decreases to 50%. Thus, the player can recognize the expectation degree by each image and further by the progressive pattern of the images. During the time until the rotation of the rotatable display elements is stopped, the player is expecting the game result and is watching carefully the progressive display of images having different expectation degrees. Therefore, the player plays the game keeping his tension in high level. As a result, the monotony of conventional game is avoided and the interest level of the game is enhanced.

In addition to the foregoing, even a beginner player can understand the mode or manner of progression of the game by watching the image displayed on the liquid crystal display 6, and also can predict the progress of various games without requiring skill. Each image that is displayed on liquid crystal display 6 has an individually determined probability to be displayed on the liquid crystal display. The fraction indicated in FIGS. 4 and 5 signify the appearance probability (probability to be displayed) of each image. The higher the expectation degree, the lower is the appearance probability. However, the displayed appearance of images determined to be low in appearance probability can be predicted by the player to predict when the player has played the game successive times. Consequently, even a skillful player can keep his interest in the game over a long period.

Although the illustrative embodiment of the invention described above employs a liquid crystal display as the secondary display, an image display such as CRT, an electric display which is arranged as an indication device of a LED, or a mechanical display such as rotatable display element for selecting an image from among a plurality of such images and to indicate same by stopping rotation, can perform the display function in a manner similar to that of the display image, described hereinabove. It should be noted that the display image that facilitates the recognition of a good game state or a dangerous game state for the player can be effected by non-image indication, such as on and off (illuminated and non-illuminated) states of a lamp, instead of a character or a picture. Additionally, sounds can be used in addition to, or instead of, the display image. Preferably, the use of sound is made to corresponding with a change of the image or the illumination state of an indicator lamp.

In the embodiment described above, liquid crystal display 6 displays the image indicating the control state of the variable display corresponding to a result of an original game. However, in other embodiments the liquid crystal display may display images of other games, i.e., different from the original game. In such an embodiment, ROM 22 of microcomputer 20 would store the data of the display image and the execution program of the different game. In a specific illustrative embodiment of the invention of this multi-game system, CPU 21 executes the operations shown in FIGS. 28 and 29.

Figure 28:
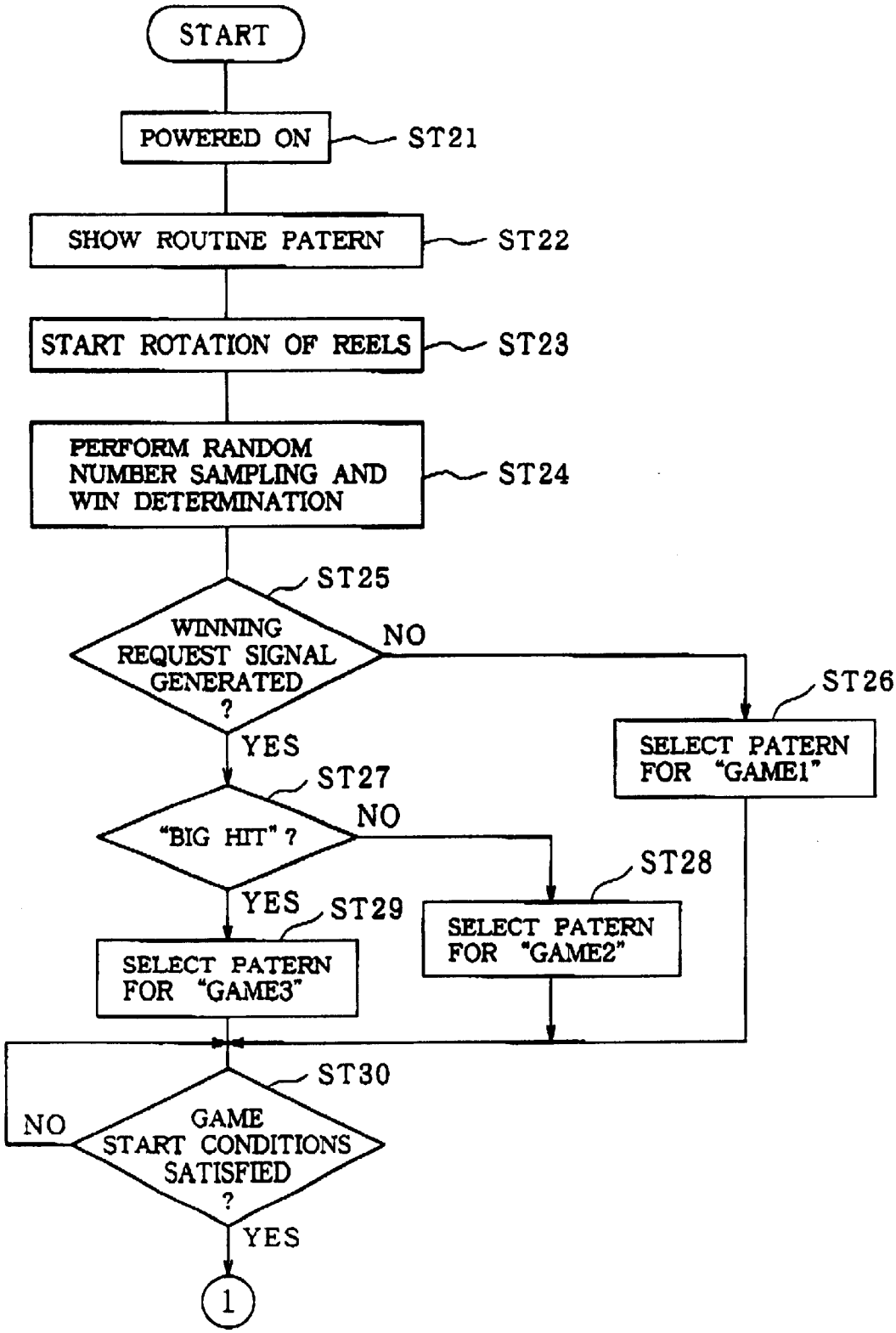
FIG. 28 is a flow chart that illustrates the handling procedures in indicating a separate play on the liquid crystal display of the embodiment of the invention.

In FIG. 28, when the gaming machine is powered up (ST21), the CPU operates liquid crystal 29. display 6 to display the "routine pattern" (ST22). When the player performed necessary operations, such as actuation of start lever 5 or spin switch 8 after insertion of medals into medal inlet 7, or after operation of 1-BET switch 9 or maximum BET switch 10, rotatable display elements 4L, 4C, 4R are rotated to start variable display (ST23). At this time, in response to sampled random number values, win or non-win conditions are determined (ST24). The CPU then determines whether a "winning request signal" has occurred, or not (ST25), and further determines the display mode of the win or of the non-win in response to the result of the judgement. These operations are similar to those shown in FIG. 3.

In the operation of the system of FIG. 28, the image displayed on liquid crystal display 6 is a pattern that corresponds to several games. More specifically, if the "winning request signal" did not occur in the determination of ST25, the CPU selects a pattern for "game 1"(ST26). When the "winning request signal" has occurred, the CPU determines whether or not the "winning request signal" corresponds to the "big hit" (ST27). The CPU then determines a pattern for "game 2"if it is "NO" (ST28), and selects a pattern for "game 3"if is "YES" (ST29). Various games can be prepared for "game 1,""game 2"and "game 3."For example, for the various games, even if the figures or pictures shown on the screen of liquid crystal display 6 are identical, the various games could have respectively different winning probabilities. If the games and the figures or pictures are respectively different for the various games, the winning probabilities would also be respectively different.

Whether a condition to start the game selected as above is satisfied or not is determined (ST30). The starting condition may be an optional condition, for example, the stopping of one rotatable display element (reel), the stopping of two rotatable display elements (reels), or the stopping of all rotatable display elements (reels). The predetermined time permitted for stopping would be predetermined. When the start condition is not "stop of all reels," a game performed by the display of liquid crystal display 6 is started during a rotation of at least one rotatable display element (reel). Consequently, the original game and the separate game on liquid crystal display 6 are played simultaneously.

Figure 29:
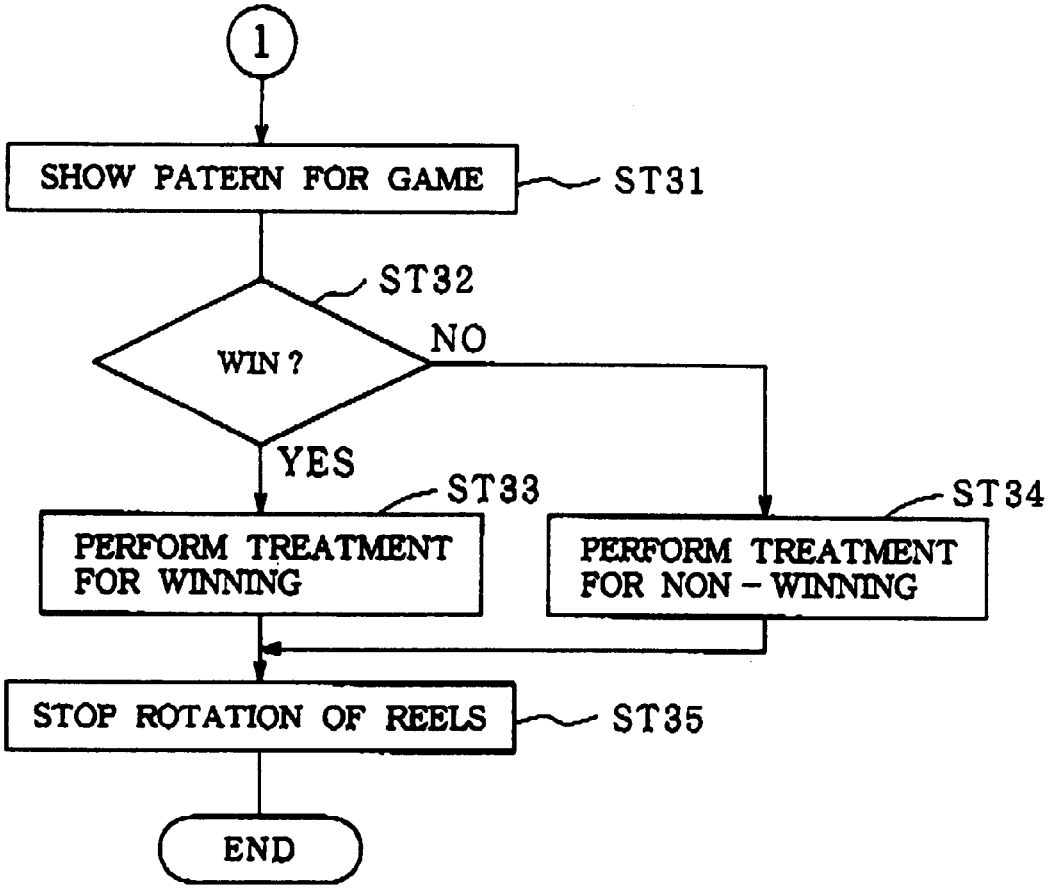
FIG. 29 is a flow chars that continues from FIG. 28.

When the start conditions is satisfied in the above determination, as shown in FIG. 29, the display of a pattern for a selected game on liquid crystal display 6 is performed (ST31), and thereby the game is played. The win judgment of this game is performed (ST32). Although this win determination may be the win or loss judgement determined by sampled random number values similarly to the original game, a special win judgment may be prepared for this game.

When determined to be a win, the winning operation is performed (ST33). A specified winning mode is displayed on liquid crystal display 6 and also as mentioned above the same operation as in the case where specified symbols of rotatable display elements 4L, 4C, 4R are arranged on winning line 14 or an individually determined operation may be performed. Alternatively, when the operation is determined to be a non-win, the non-winning operation is performed (ST34). That is, a specified non-winning mode is displayed on the liquid crystal display 6. The stop control is then performed on rotating rotatable display elements 4L, 4C, 4R (ST35). Thus, the non-winning operation is completed.

Figure 30:
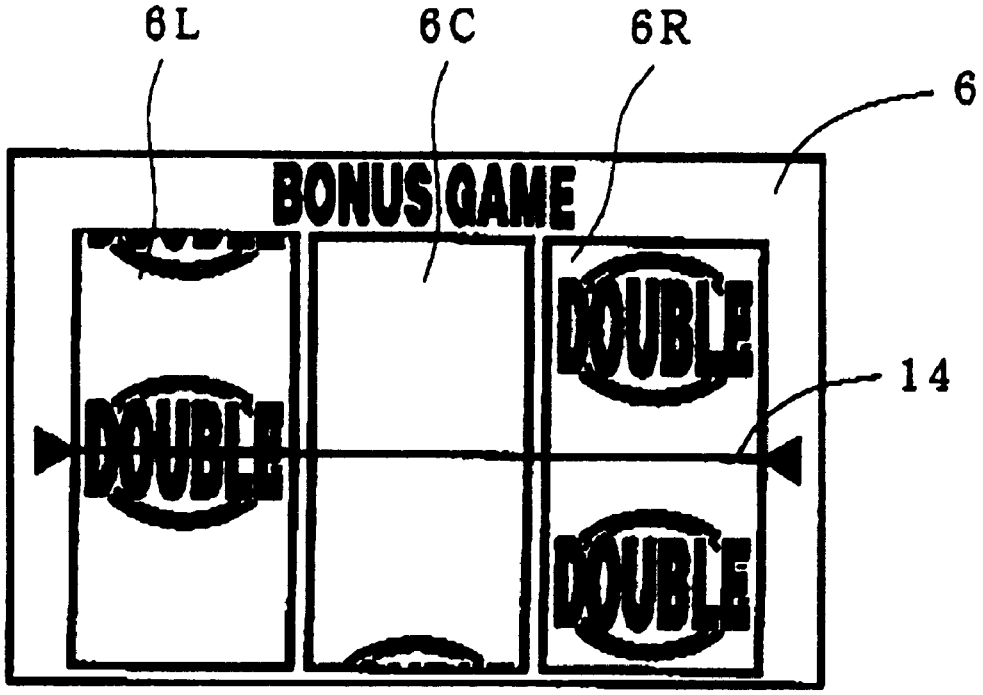
FIG. 30 is a representation that illustrates an example of display images of the separate play performed on the liquid crystal display of the embodiment of the invention.

FIG. 30 shows an example of display image of separate game performed by the liquid crystal display 6 relating to the game by rotatable display elements 4L, 4C, 4R. In this example, similarly to the three rotatable display elements 4L, 4C, 4R performing variable display of original game, an image constituting moving three symbol rows 6L, 6C, 6R which performs variable display of a plurality of symbols is displayed on the screen of the liquid crystal display 6.

The separate game in this case is prepared as the "bonus game" that is started when stop symbols on winning line 14 at the time of stop of rotation of rotatable display elements 4L, 4C, 4R are arranged in a specified winning mode. At this time a predetermined amount of medals is paid to the player as a predetermined award corresponding to the winning mode. And, by start of the "bonus game," three symbol rows 6L, 6C, 6R are variably displayed on the screen of liquid crystal display 6, and at the time when predetermined period has passed, movement of each symbol row 6L, 6C, 6R stops. When specified symbol "DOUBLE" is positioned on central line 14', a predetermined amount of medals are paid to the player once again. Accordingly, the opportunity that an award gained by a win of original game increases into two times in amount is given to the player by the "bonus game."

Further, another example of the separate game is preset such that, in case of the "lottery game" that is started when at stop of rotation of rotatable display elements 4L, 4C, 4R, stop symbols on the winning line 14 have been arranged in a specified winning mode, without previous determination of distribution of awards for the correspondence to the winning mode, stop symbols (numerals) positioned on the center line 14' at stop of variation of three symbol rows 6L, 6C, 6R, similarly to the "bonus game" described above, displayed on the screen of liquid crystal display 6 express a distribution of awards and medals are paid in an amount determined based on thus decided distribution of awards.

As described above, information of control state of the variable display that is original game or image for separate games is displayed by liquid crystal display 6 as an example of the secondary display of the invention, and in addition to these displays, a history of past game result namely the image that shows times or rate of frequency of win or loss in games finished in the past. In order to realize the purpose mentioned above, a display change button is provided in a suitable position of the front of the slot machine of FIG. 1 (for example, below the display window), and when the player pushes the display change button at an optional time during the game, the display on the screen of liquid crystal display 6 is switched to the display of times or rate of frequency of win or loss, and when the player pushes the button once again, the display on the screen is returned to the before. By the display of past records or history, player can judge the gaming machine to play whether a hit easily appears or not.

Figure 31:
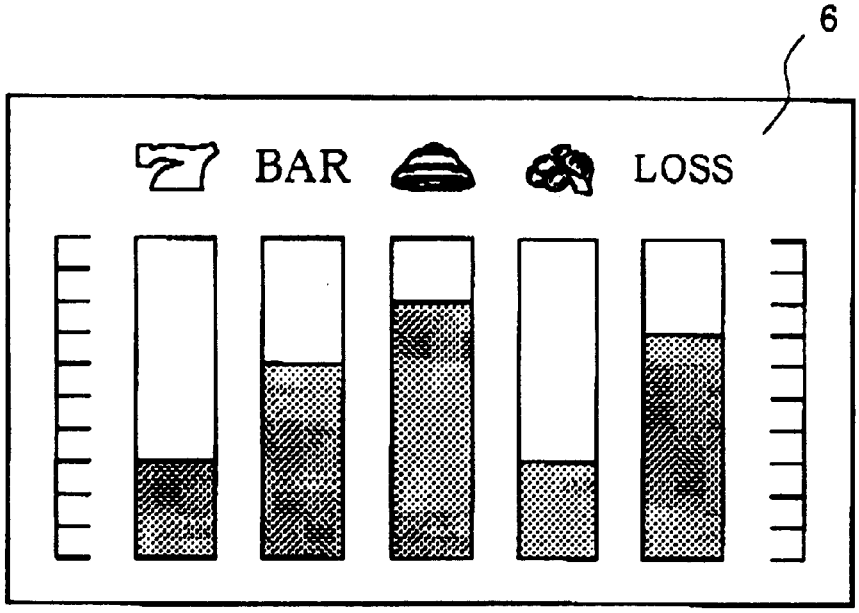
FIG. 31 is a representation that illustrates a state indicating the remaining rate of each symbol by a bar graph on the liquid crystal display of the embodiment of the invention.
Figure 32:
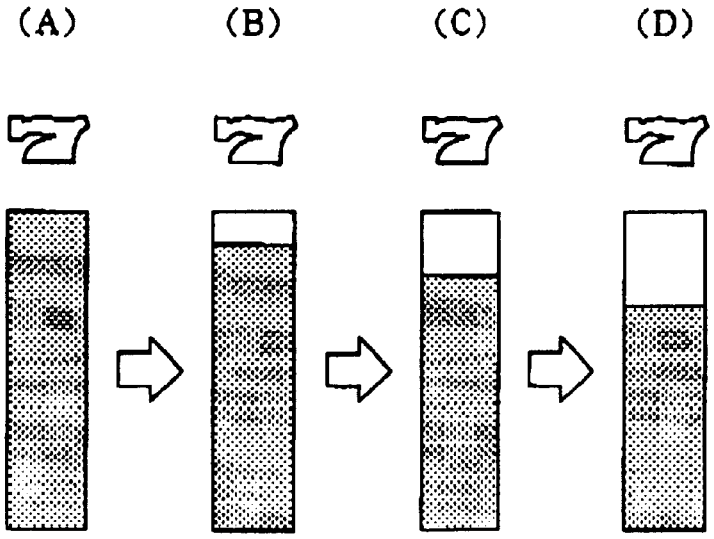
FIG. 32 is a representation that illustrates an example of the change of the bar graph display regarding a symbol of FIG. 31.
Figures 33, 34:
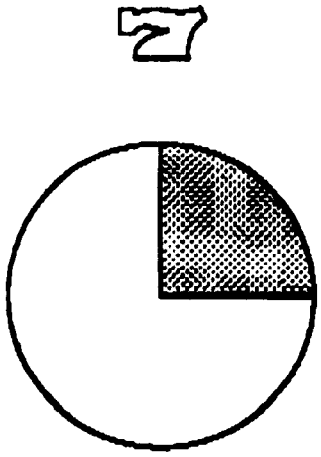
FIG. 33 is a representation that illustrates the case wherein the remaining rate of a symbol is indicated by a circle graph.
FIG. 34 is a representation that illustrates a state indicating the remaining rate of each symbol by numerals on the liquid crystal display of the embodiment of the invention.
Figure 35:
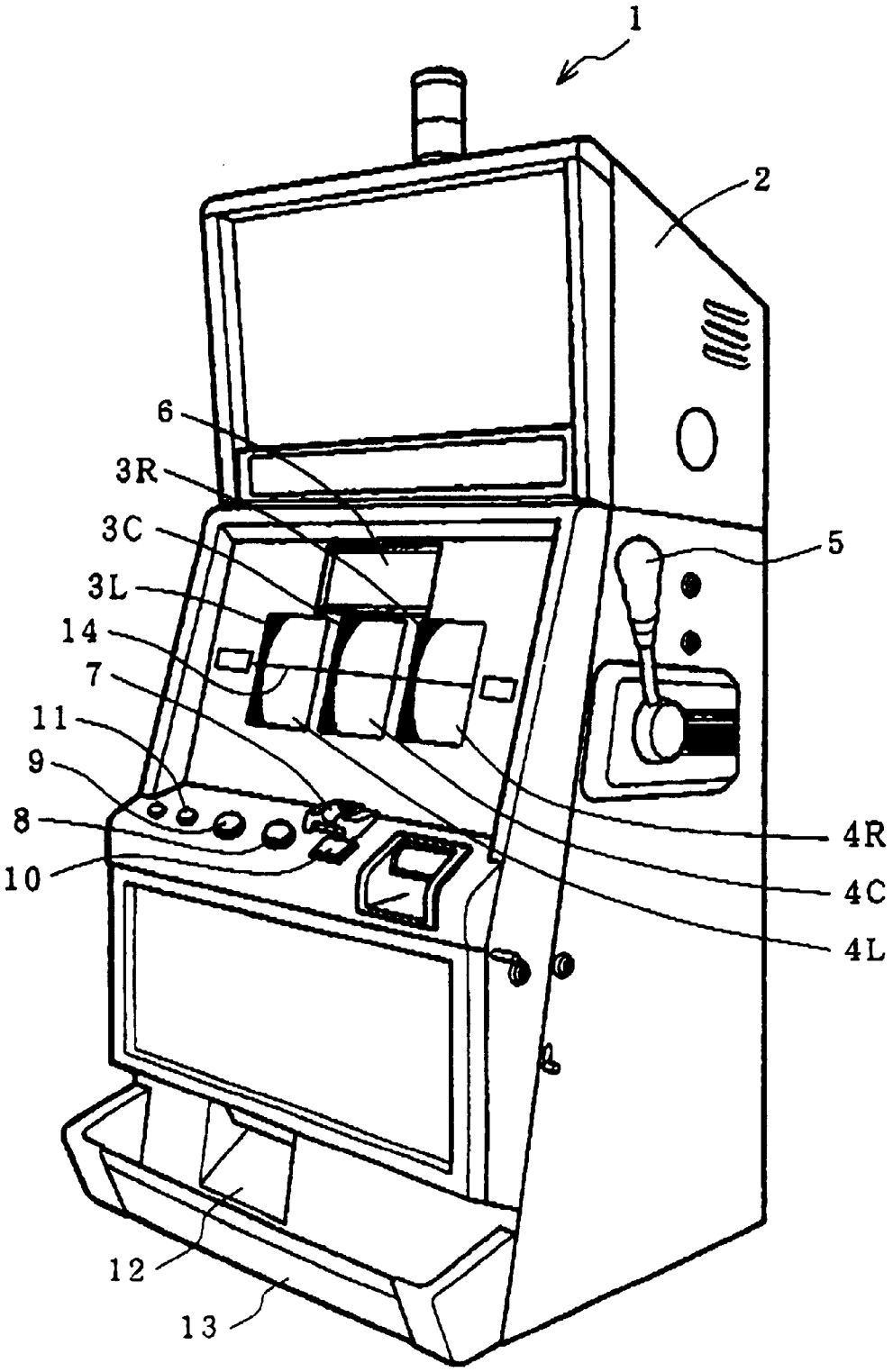
FIG. 35 is an isometric representation of a slot machine with the liquid crystal display in a different location from that of FIG. 1.

As an image showing such a game record or history, for example, survival rate of win or loss from beginning of power supply to the gaming machine (for example, frequency or times as % of win or loss assumed to occur by 10,000 times of games) is indicated by analog representation such as bar graphs as shown in FIGS. 31 and 32 or circle graph as shown in FIG. 33 or by digital representation such as numerals as shown in FIG. 34. The operation for these indications is performed by the microcomputer of the slot machine 1 or by CPU of liquid crystal display 6 itself (if provided).

In the details, in an example of FIG. 31 symbols capable of constituting combinations of win are represented by the "7," the "BAR," the "bell" (a figure), the "cherry" (a figure) and regarding these symbols and the other symbols as a whole (constituting combinations meaning the "loss" of game), each survival rate is displayed on the screen of liquid crystal display 6. The bar graph which represents survival rate (%) of each symbol, as shown in FIG. 32 using symbol "7" -as an example, at the time of power supplied or reset of the slot machine 1, represents lighting or a part indicated brightly in a state of 100% (FIG. 32A) and while a game has been repeated, lighting or a bright part decreases by 10% FIGS. 32B to 32D) at each time when the combination of stop symbols at the time of stop of three rotating rotatable display elements 4L, 4C, 4R is arranged to "7-7-7"to generate the "big hit" condition. Also in the case of circle graph of FIG. 33, survival rate (%) represented by lighting or emphasis part of each symbol decreases at each time of appearance of big hit. Representations of the other symbols are performed in the similar manner described above. In digital representation of FIG. 34, the numeral representing survival rate (%) of each symbol varies.

In a further embodiment, a slot machine that functions in accordance with the above example is an embodiment of the automatic stop control system wherein a stop button operation is not required. However, the gaming machine may be provided with stop buttons that correspond to the rotatable display elements (reels), respectively, and has incorporated therein stop conditions for each rotatable display element for the stop button operation by the player. In this case, the variable display of symbol rows 6L, 6C, 6R of the separate game by liquid crystal display 6 shown in FIG. 30 can be stopped in response to actuation of the stop button by the player.

Also, although the liquid crystal display 6 as the secondary display of the invention is disposed at a position that is lower than display window 3C in this example, the secondary display may be disposed at any position in the front surface of the gaming machine. Illustratively, the secondary display may be disposed at the upper position of display window 3L, 3C, 3R as shown in FIG. 31.

Moreover, an electric display, such as CRT display, may function as the variable display. Also, the liquid crystal display may be used instead of the mechanical rotating display elements of this example. Further, the gaming machine of the invention may be provided with a variable display having display windows, in each display window three or more symbols would be displayed and several winning lines would be made effective under predetermined conditions.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. A gaming machine comprising:

a variable display for displaying principal graphical information corresponding to at least one of a plurality of principal graphical elements, each principal graphical element having a predetermined significance in an ongoing principal game of the gaming machine;

a secondary display for displaying secondary graphical information; and a principal controller for producing first control signals that control said variable display to display the principal graphical information as a sequential principal progression of the principal graphical elements in the ongoing principal game, and second control signals that control said secondary display to display the secondary graphical information, the secondary graphical information being predictive information relating to the sequential principal progression of the principal graphical elements in the ongoing principal game.

2. The gaming machine according to claim 1, wherein the secondary graphical information is in the form of a secondary image selected by said controller from a plurality of available secondary images, the selected secondary image being displayed by said secondary display in response to said principal controller.

3. The gaming machine according to claim 1 wherein there is further provided a secondary controller that controls the operation of said secondary display to display the secondary graphical information, the secondary graphical information being in the form of a secondary image selected by said secondary controller from a plurality of available secondary images, the selection being responsive to the second control signals from said principal controller.

4. The gaming machine according to claim 2, wherein the selected secondary graphical information displayed by said secondary display is in the form of a sequential secondary progression of the secondary images, said sequential secondary progression having a determinable relationship to the sequential principal progression.

5. The gaming machine according to claim 4, wherein said secondary display displays said secondary images in the form of the sequential secondary progression of the secondary images in a predetermined order in relation to each other so as to make a story when the variable display achieves a "reach" condition whereby the principal game performed by the variable display would result in a win if a specific further principal graphical element is displayed by the variable display.

6. The gaming machine according to claim 5, wherein the specific further principal graphical element is displayed by the variable display, and said displayed specific further principal graphical element, in combination with at least one other displayed principal graphical element, constitutes a specific combination of displayed principal graphical elements by said variable display, each of the displayed graphical elements having a respectively associated degree of expectation, the specific combination of displayed principal graphical elements constituting a win condition of the principal game.

7. The gaming machine according to claim 6, wherein said secondary display displays a slow replay of the sequential secondary progression after the sequential secondary progression has been completed at least once.

8. The gaming machine according to claim 5 wherein said secondary display further displays an indication of time remaining in the play of the principal game.

9. The gaming machine according to claim 5, wherein said principal controller produces the second control signals that control said secondary display to display the secondary graphical information in accordance with a plurality of secondary display modes, each of said secondary display modes having a respectively associated sequential secondary progression.

10. The gaming machine according to claim 9, wherein each of said secondary display modes of said plurality of secondary display modes is responsive to the respectively associated degree of expectation in acquiring respective combinations of principal graphical elements to achieve a win condition of the principal game.

11. The gaming machine according to claim 9, wherein the secondary graphical information displayed by said secondary display provides predictive secondary graphical information, whereby a player will anticipate within a predetermined probability that the principal game will achieve a winning condition if the variable display displays a specific remaining graphical element in response to the secondary display mode of the sequential secondary progression.

12. The gaming machine according to claim 9, wherein the secondary graphical information includes a plurality of secondary graphical elements, each such secondary graphical element having associated therewith a respective degree of expectation of winning the principal game by obtaining a specific combination of the principal graphical elements that will be displayed by the variable display when the variation of the principal graphical elements stops.

13. The gaming machine according to claim 1, wherein said principal controller is arranged to control said variable display to display the sequential principal progression of the principal graphical elements as a sequence of two principal games, the secondary graphical information being predictive of the second principal game of the variable display.

14. The gaming machine according to claim 1, wherein said variable display comprises a plurality of variable display units disposed laterally with respect to each other, said principal controller controlling said plurality of variable display units so as to stop the variation of a centrally positioned one of said plurality of variable display units last.

15. The gaming machine according to claim 1, wherein said variable display is a mechanical variable display.

16. A method of operating a gaming machine, the method comprising the steps of:

varying principal graphical information responsive to an ongoing principal game and formed of principal graphical elements displayed on a principal display, in accordance with a determination made by a controller;

varying secondary graphical information formed of secondary graphical elements displayed on a secondary display; and anticipating a determined combination of principal graphical elements of the ongoing principal game to be displayed in the principal display in accordance with predictive information displayed in the secondary display.

17. The method of claim 16 wherein said step of anticipating comprises the further step of monitoring a progression of the secondary graphical elements displayed on the secondary display.

18. The method of claim 16 wherein said step of anticipating comprises the further step of monitoring the secondary graphical elements displayed on the secondary display.

19. The method of claim 16 wherein said step of varying secondary graphical information includes further step of depicting a story line in the secondary display.

20. The method of claim 16 wherein said step of varying secondary graphical information includes further step of providing in the secondary display timing information for a principal game of the gaming machine.

21. The method of claim 16 wherein said step of varying secondary graphical information includes further step of providing in the secondary display a secondary game additional to a principal game of the gaming machine.

22. A gaming machine, comprising:

a variable display for displaying principal graphical information responsive to an ongoing principal game; and a principal controller for producing first control signals that control said variable display to display the principal graphical information of the ongoing principal game as a sequential principal progression of the principal graphical elements, and second control signals that control said secondary display to display the secondary graphical information, the secondary graphical information having a predetermined relationship to the sequential progression of the principal graphical elements, wherein the second control signals control the secondary display to display the secondary graphical information corresponding to a secondary game that is different from the principal game, the secondary graphical information further corresponding to the likelihood of winning the ongoing principal game.

23. The gaming machine according to claim 22, wherein said variable display has a working mode wherein the principal graphical elements are translated sequentially, and a display mode wherein at least one of the plurality of principal graphical elements is continuously displayed, the secondary graphical information being selected from a plurality of available secondary images while said variable display is in the working mode, the secondary graphical information corresponding to a secondary game that is different from the principal game.

24. A gaming machine comprising:

a variable display for displaying principal graphical information corresponding to at least one of a plurality of principal graphical elements, each principal graphical element having a predetermined significance in an ongoing principal game of the gaming machine;

a secondary display for displaying secondary graphical information, and a principal controller for producing first control signals that control said variable display to display the principal graphical information as a sequential principal progression of the principal graphical elements, and second control signals that control said secondary display to display the secondary graphical information, the secondary graphical information having a predetermined relationship to the sequential progression of the principal graphical elements, the secondary graphical information including historical information of prior principal games, and further corresponding to the likelihood of winning the ongoing principal game.

25. The gaming machine according to claim 24, wherein said historical information of the principal game is indicated in response to a rate of wins or losses since a powering-up of the gaming machine.

* * * * *